US005513951A

United States Patent [19]

Komoda et al.

[11] Patent Number: 5,513,951

[45] Date of Patent: May 7, 1996

[54] BLOWER DEVICE

[75] Inventors: Shuji Komoda, Chiryuu; Kazuhiro Takeuchi, Okazaki; Akira Yamanaka, Gifu, all of Japan

[73] Assignee: Nippondenso Co., Ltd., Kariya, Japan

[21] Appl. No.: 220,014

[22] Filed: Mar. 28, 1994

[30] Foreign Application Priority Data

| | | | |
|---|---|---|---|
| Mar. 29, 1993 | [JP] | Japan | 5-070433 |
| Mar. 30, 1993 | [JP] | Japan | 5-072583 |
| Dec. 17, 1993 | [JP] | Japan | 5-318296 |
| Jan. 24, 1994 | [JP] | Japan | 6-005598 |

[51] Int. Cl.[6] ..... F04D 29/66

[52] U.S. Cl. ..... 415/119; 415/185; 416/223 R; 416/238

[58] Field of Search ..... 416/169 A, 189, 416/223 R, 238; 415/119, 185, 210.1, 211.2

[56] References Cited

U.S. PATENT DOCUMENTS

| | | | |
|---|---|---|---|
| 4,569,631 | 2/1986 | Gray, III | 416/238 |
| 4,569,632 | 2/1986 | Gray, III | 416/238 |
| 4,685,513 | 8/1987 | Longhouse et al. | 416/238 |
| 5,273,400 | 11/1993 | Amr | 416/189 |
| 5,297,931 | 3/1994 | Yapp et al. | 416/223 R |
| 5,312,230 | 5/1994 | Oda et al. | 416/223 R |
| 5,320,493 | 6/1994 | Shih et al. | 416/238 |
| 5,326,225 | 7/1994 | Gallivan et al. | 416/189 |

FOREIGN PATENT DOCUMENTS

| | | | |
|---|---|---|---|
| 2470879 | 6/1981 | France | 415/119 |
| 115911 | 10/1978 | Japan | 416/223 R |
| 62-223499 | 10/1987 | Japan . | |

*Primary Examiner*—Edward K. Look
*Assistant Examiner*—James A. Larson
*Attorney, Agent, or Firm*—Cushman, Darby & Cushman

[57] ABSTRACT

The present invention relates to a fan having a plurality of equiangularly spaced, radially extending blades. The spacing provided between adjacent blades is substantially constant along the entire radial length of the blade for increasing a blowing efficiency, while also allowing a mold separation operation along the axial direction during the formation of the fan using a mold. In a case where the blade is a sweep-forward blade, the number of the blades is seven or more and has a sweep-forward angle of the blades between 35 to 45 degrees. Finally, in case where an electric motor for rotating the fan is supported by stays, the number of stay member and the number of blades, which are not evenly dividable by each other, should satisfy a relationship of $2{,}000<x\times y\times Nf/60$, where $N_f$ is a rotational speed of the fan.

11 Claims, 30 Drawing Sheets

Fig. 22
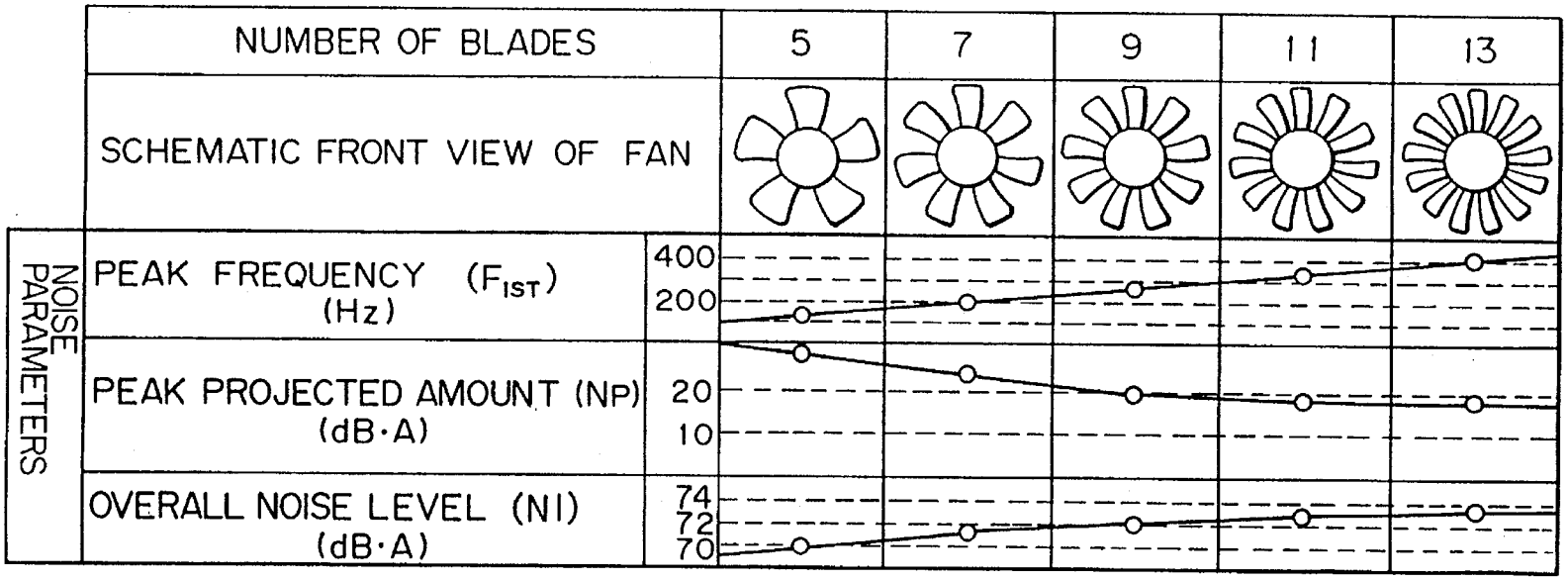
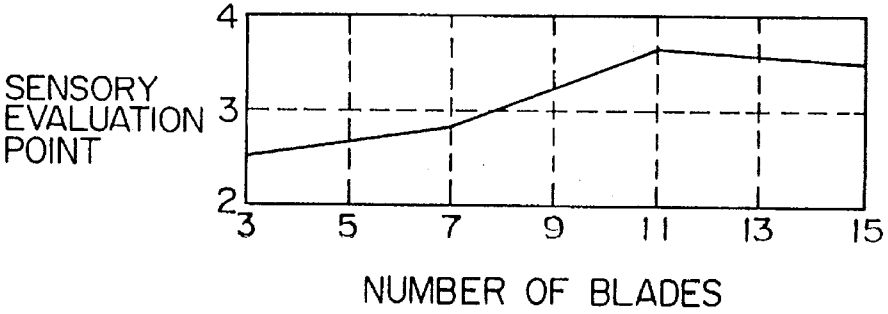
Fig. 23

BLOWER DEVICE

BACKGROUND OF THE INVENTION

1. Field of the Invention

The present invention relates to a blower device including an axial flow fan, which is, for example, used for obtaining an air flow directed to a radiator for an internal combustion engine.

2. Description of Related Art

Known is an axial flow fan for a radiator in an internal combustion engine where the fan has a plurality of circumferentially spaced blades with each blade extending radially. The small axial dimension of the fan necessitates the number of the blades being increased, for example, to seven or more. However, in the prior art, such an increase in the number of blades causes the efficiency to be reduced, due to the fact that seven or more fan blades causes the solidity of the blade, which is a ratio of a chord length of a blade to a blade pitch, to be greatly reduced. Namely, a reduction in the solidity causes the chord length to be highly reduced and this causes a pressure gradient on the surface of the blade to be increased thereby causing air flows to separate from the surface.

Furthermore, the prior art fan generates a large operating noise when the fan is used as a pushing flow type. This is the case when the fan is arranged between a front grill and a heat exchanger such as a condenser in an engine compartment for a vehicle, so that a flow of air is sucked from the grill and pushed to the heat exchanger is created.

SUMMARY OF THE INVENTION

An object of the present invention is to provide an axial flow fan capable of reducing its axial size, while also preventing the reduction in its blowing performance.

Another object of the present invention is to provide an axial flow fan with reduced operating noise.

Yet another object of the present invention is to optimize the noise reduction using a number x of the stay members and a number y of the blades to satisfy the following relationship, $2{,}000 < x \times y \times (N_f/60)$, where $N_f$ is a rotational speed of the fan.

These objects are achieved in the present invention with a fan comprising more than seven blades, a substantially constant width or gap between said blades, and a sweep angle between 35 and 45 degrees.

The invention may have an inclination angle between −20 and +10 degrees at the root of the blade and between 50 and 70 degrees at the tip of the blade. The invention may also have a ratio of bending height in the range between 7% and 15%. The invention might also have a solidity factor anywhere between 0.7 and 0.95.

Other objects, features, and characteristics of the present invention as well as the methods of operation and functions of the related elements of structure, and the combination of parts and economics of manufacture will become more apparent upon consideration of the following description and the appended claims with reference to the accompanying drawings, all of which form part of this specification.

BRIEF DESCRIPTION OF ATTACHED DRAWINGS

FIG. 1 schematically illustrates an arrangement of parts in an engine compartment of an automobile.

FIG. 22 shows front views of fans and characteristics of the noise parameters related to the fans depicted.

FIG. 23 depicts the relationship between the number of blades and the sensory noise evaluation point.

DESCRIPTION OF THE PREFERRED EMBODIMENTS

Figure 1:
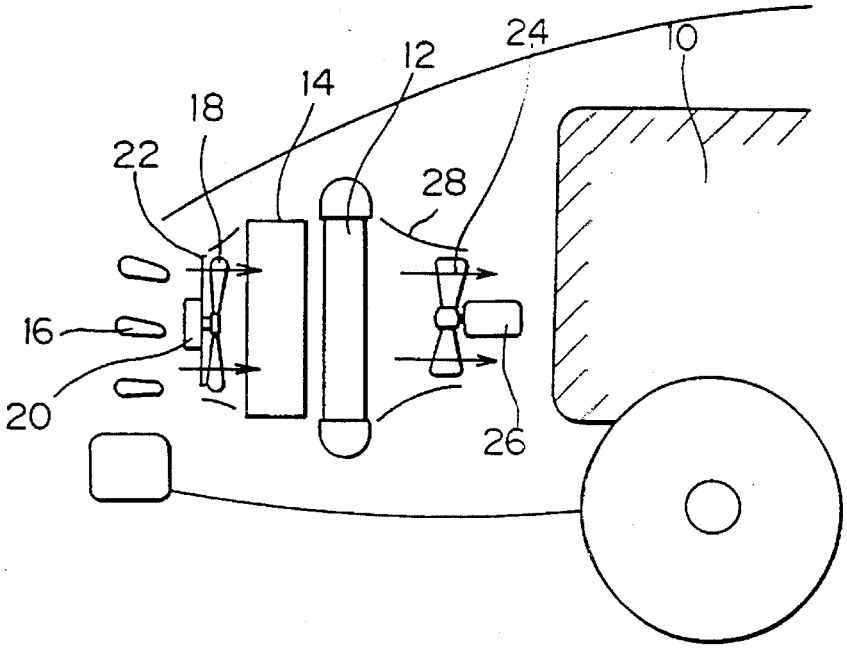

FIG. 1, schematically shows an arrangement of some parts in an engine compartment of an automobile, including a water cooled internal combustion engine 10, a radiator 12, a condenser 14 located in a refrigerating circuit (not shown) for an air conditioning system, and a front grill 16 for introduction of outside air into the engine compartment. A fan 18 is arranged between the front grill 16 and the condenser 14, so that an air flow toward the condenser 14 is generated by the rotation of the fan 18. An electric motor 20 is connected to the fan 18 and the motor 20 turns the fan 18. A stay assembly 22 is for supporting the motor 20. A second fan 24 is arranged between the radiator 12 and the engine 10, so that an air flow passes through the radiator 12. A fan motor 26 is provided for obtaining a rotating movement by the fan 24. A shroud 28 can be put between the radiator 12 and the fan 24.

A detailed construction of the present invention will now be explained. Although the present invention explains a pushing flow type fan 18, the present invention can also be applied to a sucking flow type fan.

Figure 2:
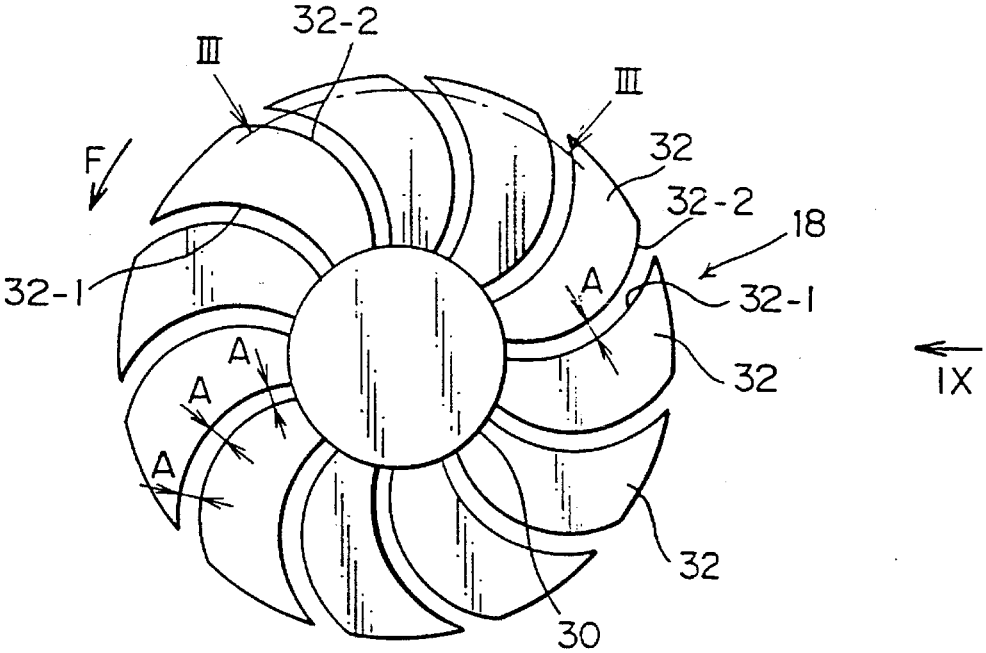
FIG. 2 is a front view of a fan in FIG. 1.
Figure 3:
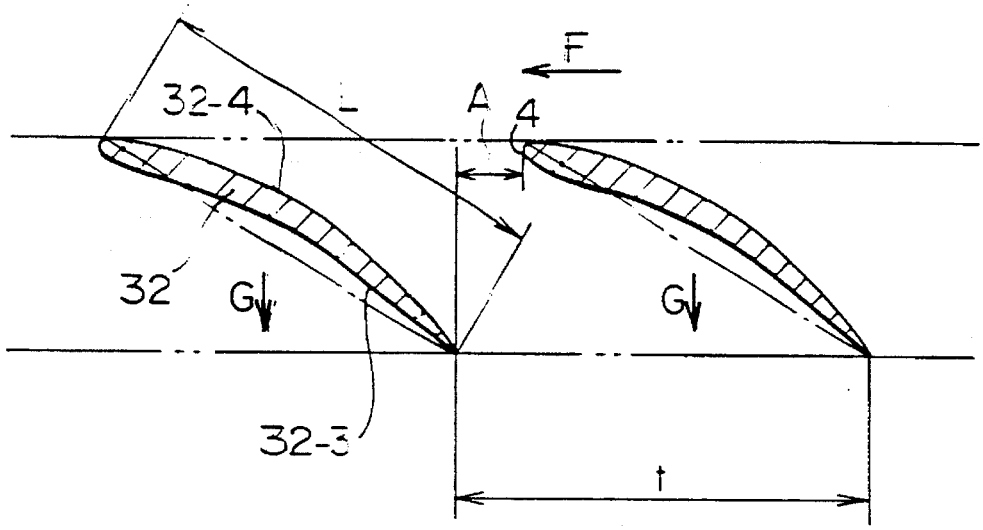
FIG. 3 is cross-sectional view taken along line III—III in FIG. 2.

FIG. 2 is a front view of the fan 18 which is, in FIG. 1 connected to the electric motor 20, which may be replaced by a transmission mechanism for receiving a rotational movement from a crankshaft of the engine or a hydraulic motor. The fan 18, made of a suitable material such as a resin or metal, is provided with a boss 30 having an axis of rotation which is perpendicular to the plane of the page in FIG. 2, and eleven equiangularly spaced blades 32, each extending radially outwardly from the boss 30. As shown in FIG. 2, in a projected plane perpendicular to the axis of the rotation of the fan 18, each blade 32 has a curved front edge 32-1 and a curved rear edge 32-2 in a direction of the rotation of the fan 18 as shown by an arrow F. The curved shape of the edges 32-1 and 32-2 are such that further from the boss 33, the larger the angle of the edge is with respect to the direction F of the rotation of the fan; note the changing angles of A in FIG. 2. As shown in FIG. 3, each blade 32 has, at a circumferential plane about the axis of the rotation of a fixed radius, a cross-sectional profile having axially spaced apart front and rear arc shaped edges 32-3 and 32-4 respectively, which are forwardly inclined with respect to the direction F of the rotation of the fan. This causes a forward flow of air, as shown by an arrow G, which is directed to the condenser.

In the axial projected plane as shown in FIG. 2, a gap A is created between the blades 32. The further out each blade 32 one goes from the boss 30, the larger the circumferential width of the blade. Thus, a substantially constant width of the gap A is obtained along the entire radial length of the blade 32, from a blade's inner end connected to the boss 30 to the blade's outermost end. The size of the gap A should be as small as possible, while maintaining the possibility that the fan can be integrally formed in a mold.

Figure 4:
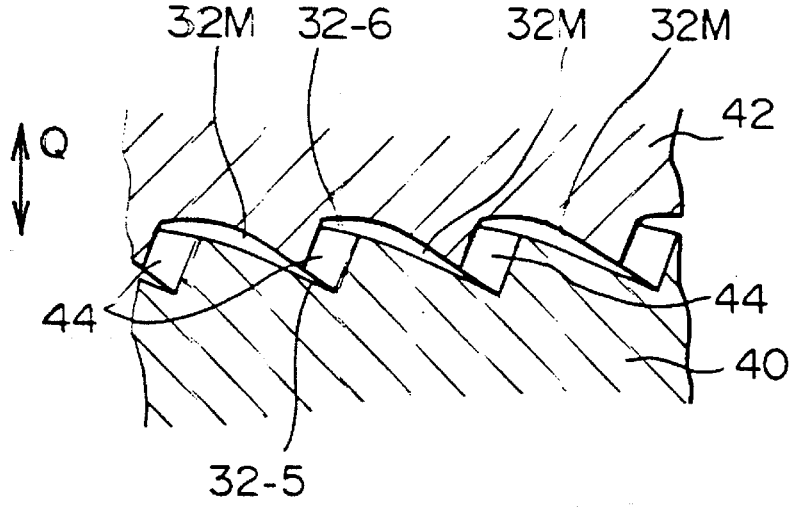
FIG. 4 is a cross-sectional view of a mold for forming the fan in FIG. 2.

Next, the reason why the gap A is necessary to obtain integral molding of the fan will be explained. As shown in FIG. 4, a mold is constructed by a first mold section 40 and a second mold section 42, which are movable relative to each other in a direction Q, which is substantially parallel to the direction of the rotating axis of the fan. Between the mold sections 40 and 42, spaces 32M corresponding to the respective blades 32 are created. In the arrangement of the mold sections 40 and 42 in FIG. 4, the spaces 32M for the formation of the blades are overlapped when viewed from the axis of the rotation of the fan 18. From the axis of rotation vantage point, the rear end 32-5 will be superimposed on the front end 32-6. In order to allow the mold sections 40 and 42 to be separated along the direction Q, a recess 44 could be necessary between the adjacent spaces 32M. The existence of such a recess 44 causes the blades 32 to be connected to each other by material filling the recess 44 when molding. This causes the molded fan to be unusable.

Figure 5:
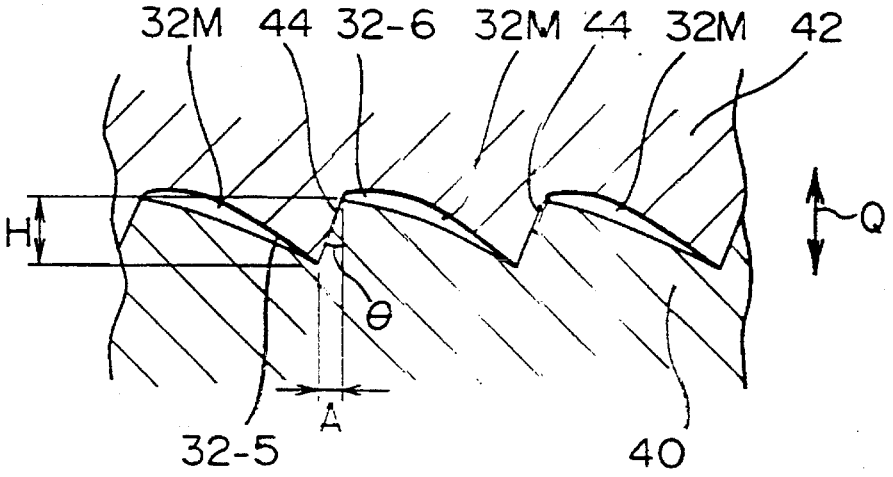
FIGS. 5 and 6 are similar to FIG. 4 but show modifications of a mold.

From the theoretical viewpoint, it is possible that the rear end of a blade and the front end of an adjacent blade can be adjoined along a line substantially parallel to the axis of the rotation of the fan 18. However, such a construction would make it difficult for mold sections 40 and 42 to be easily separated. Thus, it is not practical for the rear end of a blade and the front end of an adjacent blade to be adjoined to each other. As shown in FIG. 5, between the mold spaces 32M, mold sections 40 and 42 are provided with circumferentially spaced contacting sloped surfaces 44, which are inclined at an angle $\Theta$ with respect to the axis of the rotation of the fan 18. This allows the mold sections 40 and 42 to be easily separated from each other in the direction Q after the molding operation. Due to the provision of angle $\Theta$ at the contacting sections 44, the gap A is created between the rear end 32-5 of a blade and the front end 32-6 of the following blade when viewed along the axis of rotation of the fan 18 in FIG. 3. The size of the gap A depends on the axial length of the contacting surfaces 44. Practically, the value of the gap A is equal to $H \times \tan\Theta$, where H is the axial distance between the ends 32-5 and 32-6.

Figure 6:
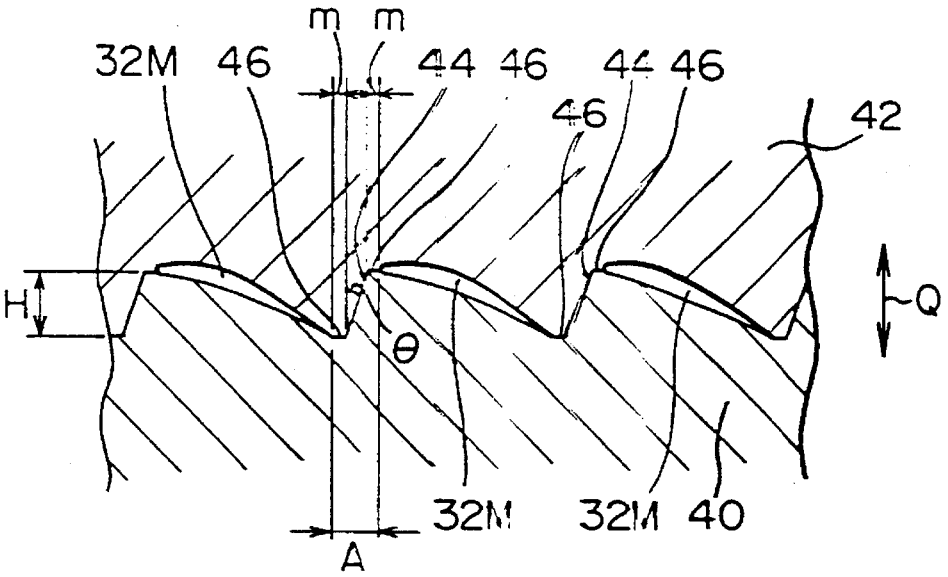
Figure 7:
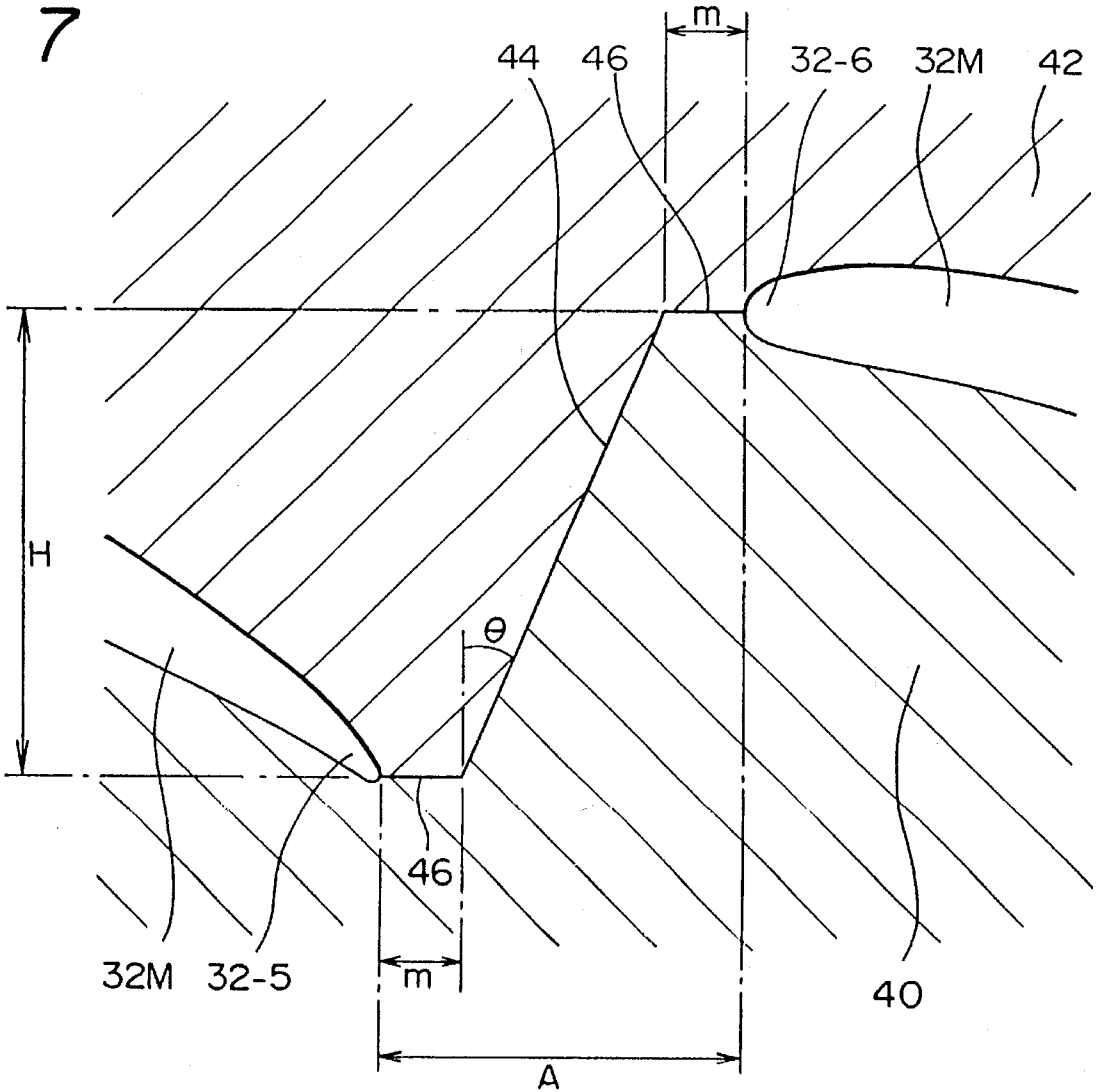
FIG. 7 is an enlarged view of a part in FIG. 6.

As shown in FIGS. 6 and 7, in order to increase the service life of the mold and ease mold separation, flat surface portions 46 extending perpendicular to the direction Q of the separation of the mold are provided at both ends of the sloped portions 46. A length m of such flat surface portions 46 depends on various factors, such as the material of the fan 18, temperature and pressure of the resin or metal introduced into the mold spaces 32M between the mold sections 40 and 42, and a designed service life of the mold sections 40 and 42. The provision of such flat surface portions 46 causes the value of the gap A between the adjacent blades to be theoretically increased to $H \times \tan\Theta + 2 \times m$. According to the present invention, a constant gap which is as small as possible and allows the molding operation to be reasonably executed, is determined by the equation $H \times \tan\Theta + 2 \times m$ and provided along the entire radial length from the inner end to the outer end of each blade.

It should be noted that the flat portions 46 must not necessarily be extended perpendicular to the axis of the rotation of the fan. The portions 46 can have another arrangement which allows the service life of the mold to be increased, such as one having an inclined or curved surface which is connected smoothly to the sloped surface 44.

Figure 8:
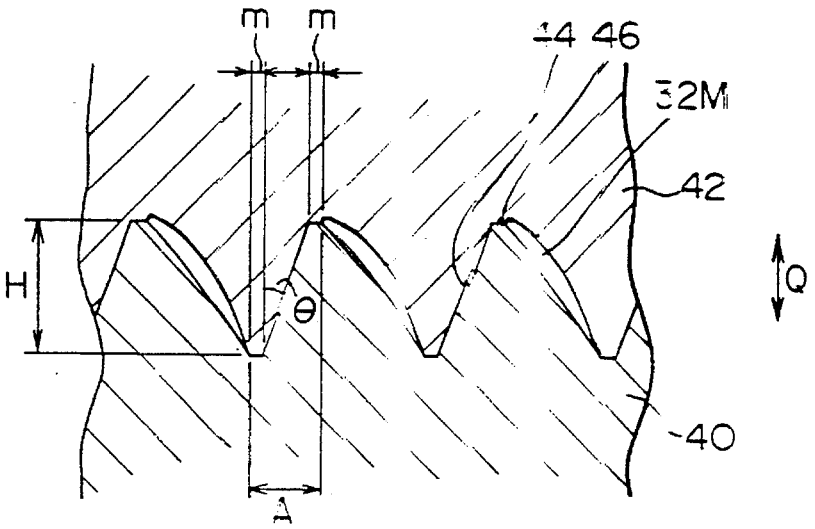
FIG. 8 is similar to FIG. 4 but shows still another modification of a mold for forming the fan in FIG. 2.

FIG. 8 shows another arrangement of the mold for obtaining blades which are inclined more deeply with respect to the direction of the rotation of the fan than that previously shown in FIGS. 5 and 6.

Figure 9:
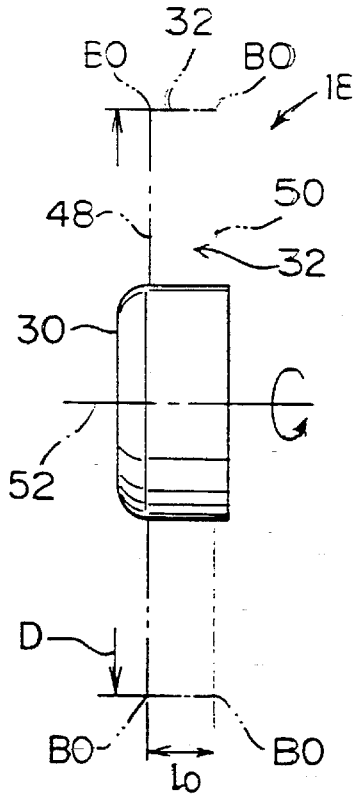
FIG. 9 is a side view of the fan according to the present invention taken along a line IX in FIG. 2.

In FIG. 9, a phantom line indicates a trajectory of the blades 32 of the fan 18 viewed from its side along an arrow IX in FIG. 2 when the fan 18 is rotating. As can easily be seen from FIG. 9, the blades 32, when viewed from the side, form a radially elongated rectangular shape having front edges 48 and rear edges 50 which extend perpendicular to the axis 52 of the rotation of the fan 18.

Figure 10A:
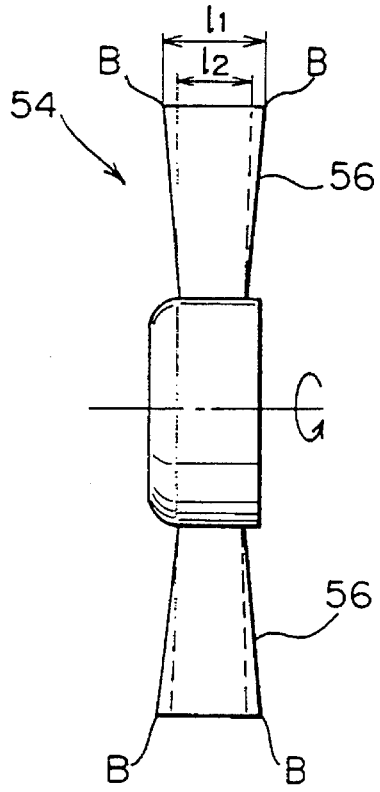
Fig. 10A PRIOR ART
FIG. 10A is similar to FIG. 9 but illustrates a fan in a prior art.
Figure 10B:
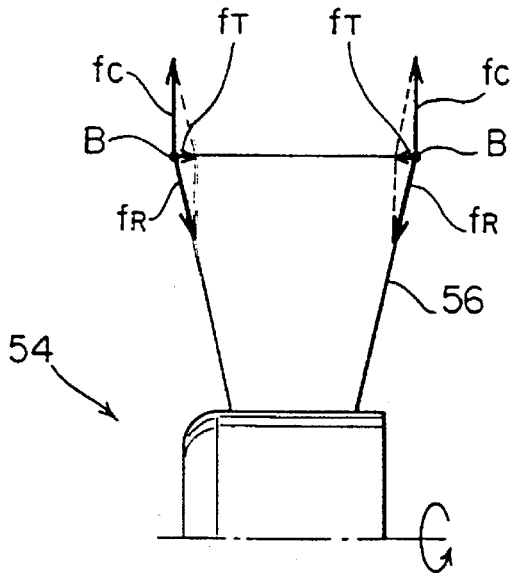
Fig. 10B PRIOR ART
FIG. 10B is an enlarged partial view of FIG. 10A.

FIG. 10A shows a similar trajectory of blades 56 of a fan 54 in a prior art, where the trajectory forms a radially outwardly opened, trapezoidal shape. In this case, the rotating movement of the fan 54 causes a centrifugal force $f_c$ as shown in FIG. 10B to be created at the outer corners B of the blade 56, causing a reacting force $f_R$ to be created in the blade 56. As a result, opposite forces $f_T$, which are a combination of the forces $f_c$ and $f_R$, are generated at the corners B. These forces $f_T$ are directed inwardly toward each other. The inwardly directed opposite forces $f_T$ cause the axial thickness of the blade 56 to be reduced from $l_1$ to $l_2$ which is shown by a dotted line in FIG. 10A. Such a reduction in the thickness of the blade 56 causes the attachment angle of the blade 56 to be reduced, thereby reducing the blowing capacity of the fan 56.

Figure 11A:
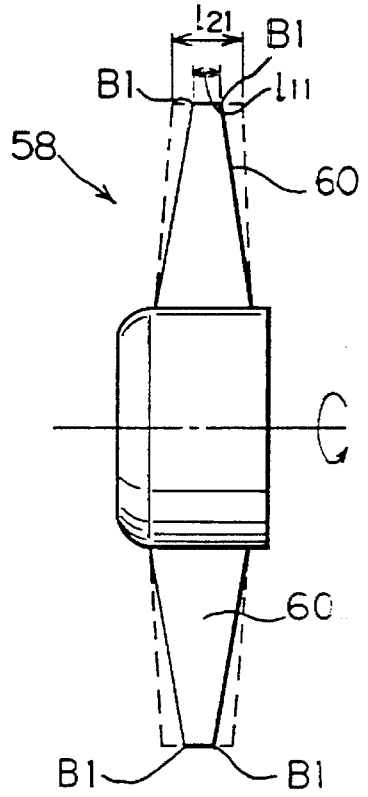
Fig. 11A PRIOR ART
FIG. 11A is similar to FIG. 9 but illustrates a prior art fan.
Figure 11B:
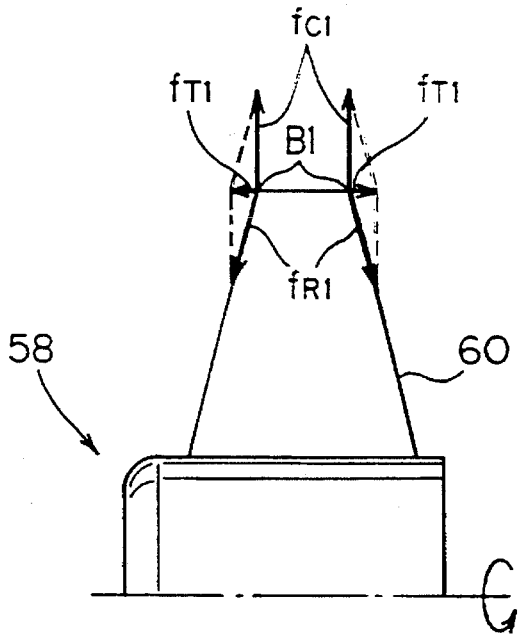
Fig. 11B PRIOR ART
FIG. 11B is an enlarged partial view of FIG. 11A.

FIG. 11A shows a similar trajectory of the blades of a fan 58 also found in the prior art where the trajectory forms a radially outwardly narrowed trapezoidal shape. The rotating movement of the fan 58 causes a centrifugal force $f_{CL}$, shown in FIG. 11B, created at the outer corners B1 of the blade 60. This causes a reacting force $f_{RL}$ in the blade 60 and therefore opposite forces $f_{TL}$, which are a combination of the forces $f_{CL}$ and $f_{RL}$, are generated at the corners B1, so that these forces $f_{TL}$ are directed outwardly away from each other. The outwardly directed opposite forces $f_{TL}$ cause the axial thickness of the blade 60 to be increased from $l_{1L}$ to $l_{2L}$ as shown by a dotted line in FIG. 11A. Such an increase in the thickness of the blade 60 causes the attachment angle of the blade 56 to be increased, thereby increasing the air blowing efficiency. However, the increase in the blade attaching angle, also, causes the rotating torque of the fan 58 to be increased; so that consumption of electric power is increased when the motor 20 for driving the fan 58 is an electrically driven type, or consumption of engine power is increased when the fan 58 is driven by the engine itself.

In view of the above difficulty, as explained with reference to FIGS. 10A and 10B, and 11A and 11B, a distribution of thickness of the blades can be designed so as not to have any deformation caused by the centrifugal force. The solution necessitates a calculation to obtain the desired distribution of the thickness of the blade, which is varied when a design of the blade is changed, on one hand, and causes a drawback that is an increase in the weight of the fan due to the increased thickness of the fan blade, on the other hand.

The rectangular trajectory of the fan 18, as viewed from its side and shown in FIG. 9, generates a centrifugal force and a resultant reaction force, which are in a direction perpendicular to the axis 52 of the rotation of the fan 18 at the corner portions B0 of the fan 18. Thus, the centrifugal and resultant reaction forces do not generate any combined force such as $f_T$ shown in FIGS. 10B and 11B. As a result, no axial deformation of the fan blades 32 occurs. As a result, in the embodiment in FIG. 9, the fan blades 32 maintain their fixed axial length $l_o$, i.e., and attachment angle irrespective of the rotating movement of the fan 18. This prevents the air flow amount and the driving torque from varying. Thus, a calculating process for determining the optimum distribution of the thickness of the fan blade becomes unnecessary, on one hand, and an increase in the weight of the fan is prevented since an increase in the width of the fan blade is not warranted, on the other hand.

An important effect of the fan 18, is that a relative increase in the circumferential length L (FIG. 3) of the blades 32 is obtained, while the number of the blades 32 can be as large as eleven due to the fact that, between adjacent blades 32, a gap A of substantially constant value is obtained along the entire radial length from the blade portion attached to the boss to the outer blade end. Such a construction is effective for suppressing a pressure gradient on the blade surface and for suppressing the separation of the air flow from the blade surface. As a result, the axial flow fan 18 with eleven blades 32, according to the embodiment in FIG. 2, can obtain an increased air blowing efficiency.

Figure 12:
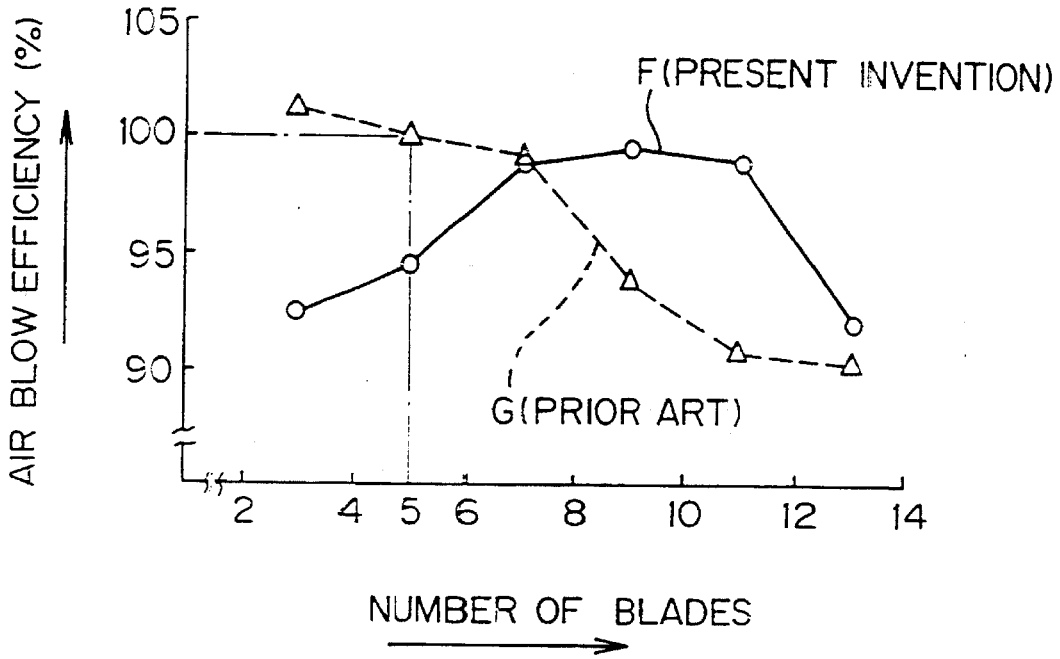
FIG. 12 shows the relationships between the number of blades and the air blowing efficiency for the present invention and the prior art.
Figure 13:
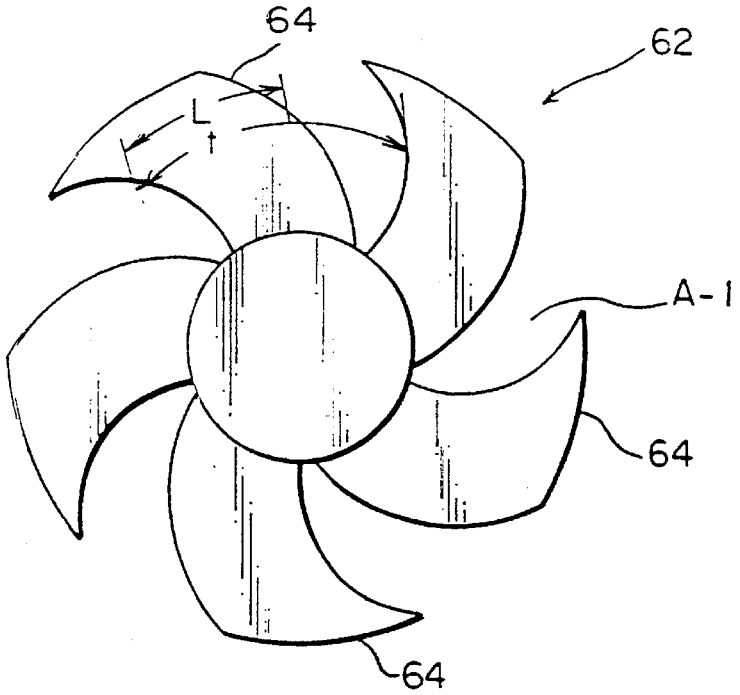
Fig. 13 PRIOR ART
FIG. 13 is a front view of a prior art fan.
Figure 14:
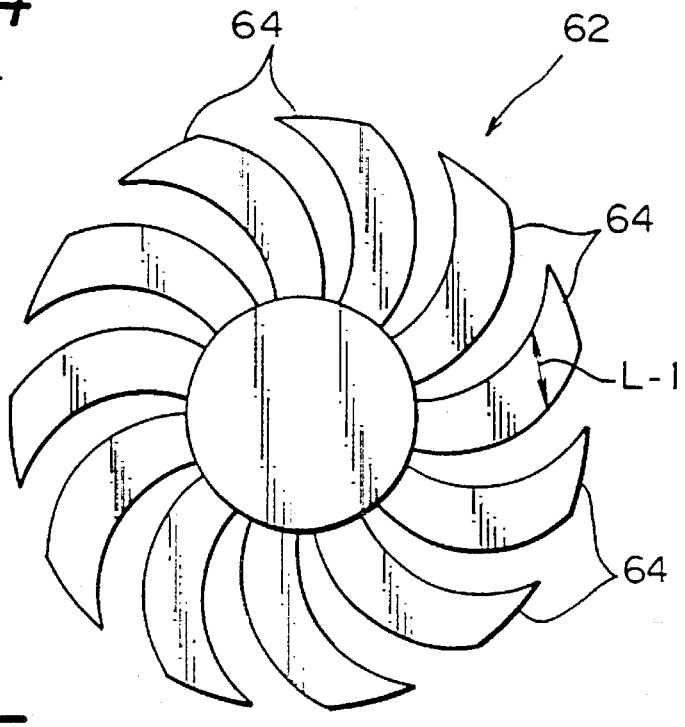
Fig. 14 PRIOR ART
FIG. 14 is a front view of a fan also in the prior art.

FIG. 12 shows relationships between the number of blades 32 and air blowing efficiency. In FIG. 12, a line F shows the characteristics of the fan 18 according to the present invention, where a substantially constant radial gap A is provided between adjacent blades 32. Contrary to this, line G shows the characteristics of the prior art fan as shown in FIG. 13, where the fan 62 has a plurality of blades 64 and a radially outwardly increasing gap A-1 created between adjacent blades 64. In this prior art construction of the fan 62, the solidity value, which is a ratio of a projected length of a chord L of a blade 32 to a blade pitch t, is smaller than 0.6. This prior art fan 62 (FIG. 13) with the reduced solidity value causes the blowing efficiency to be highly reduced when the number of the blades is equal to seven or more. This is illustrated by the curve G in FIG. 12. With the prior art fan having a solidity value smaller than 0.6, and increasing the number of the blades 64 to eleven for example, as shown in FIG. 14, the value of circumferential length L-1 is excessively reduced so that a pressure gradient on the blade surface is increased. This causes the air flow to be separated, from the surface, and thereby reduces the air blowing efficiency as shown by the curve G in FIG. 12. This is the reason that the number of blades 64 in the prior art fan 62 is seven or less. In other words, there is an inevitable limit in the reduction in the axial length of the fan 62 by increasing the number of the fan blades 64.

According to the construction of the fan 18 with the constant gap A as shown in FIG. 2, an increase in the air blowing efficiency is obtained when the number of the blades 32 is greater than or equal to six. This is shown by the curve F in FIG. 12. It should be noted that the air blowing efficiency on the y-coordinate in FIG. 12 is expressed by percentage when the efficiency of the prior art fan 64 having 5 blades has 100% efficiency.

What is clear from FIG. 12 is that, in the prior art fan 62 with the solidity value lower than 0.6, a reduction of the air blowing efficiency is obtained when the number of the blades 64 is seven or more, and, in the fan 18 of the present invention, an increased blowing efficiency is obtained when the number of the blades 32 is seven or more.

In the present invention, if the number of blades is seven or less, this causes the air blowing efficiency to be reduced, because such a reduction in the number of the blades 32 causes the blade length L to be greatly increased, so much so that a separation of the air flow from the blade surface occurs due to a development in the boundary layer in the flow of the air. This causes the axial length of the fan 18 to be increased so much that the space between the fan 18 and the adjacent heat exchanger, that is the condenser 14 in FIG. 1, is reduced, thereby generating an interference between the fan 18 and the condenser. Furthermore, in FIG. 12, a number of fan blades 32 more than eleven causes the air blowing efficiency to be reduced as shown in FIG. 12 due to the fact that the circumferential blade length L is excessively reduced.

Figure 15:
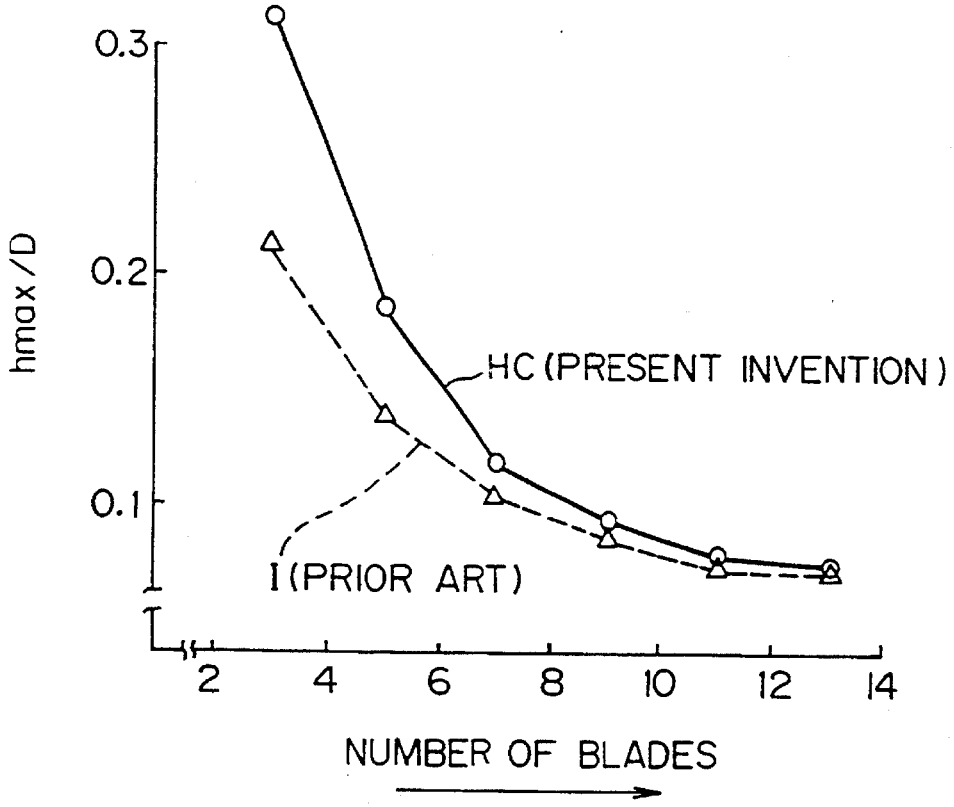
FIG. 15 shows the relationship between the number of blades and the degree of ease of mounting.

In FIG. 15, a solid curve HC shows a relationship between the number of blades 32 and a ratio of the maximum value $h_{max}$ of the axial length ($l_0$ in FIG. 9) of the fan 18 to the diameter of the fan D according to the present invention. This is indicative of a space utilization factor of the fan 18 in the engine room in that the smaller the value of the ratio, the smaller the area occupied by the fan 18. It is clear that larger the number of blades, the lower the value of the ratio. In FIG. 15, a dotted curve I shows a similar relationship for the fan 62 in the prior art where the value of the solidity is smaller than 0.6. A comparison of the curves HC (present invention) and the curve I (prior art) reveals that if the number of blades 32 is less than seven this causes the space factor of the fan 18 (FIG. 2) to be reduced more than that of the prior art fan 62 (FIG. 13). If the number of blades 32 is seven or more, the space factor of the fan 18 is compatible with that of the fan 62 in the prior art.

Figure 16:
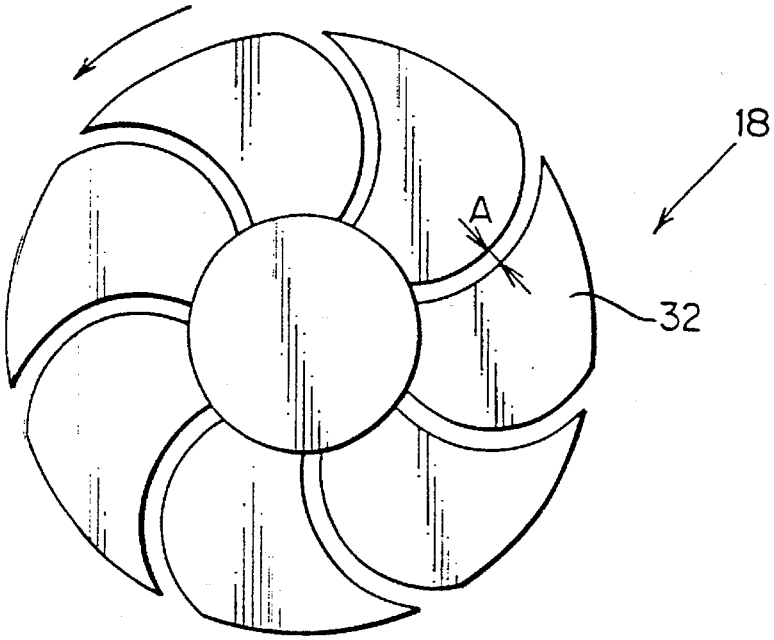
FIGS. 16 and 17 are similar to FIG. 2, but illustrate modifications of the present invention.
Figure 17:
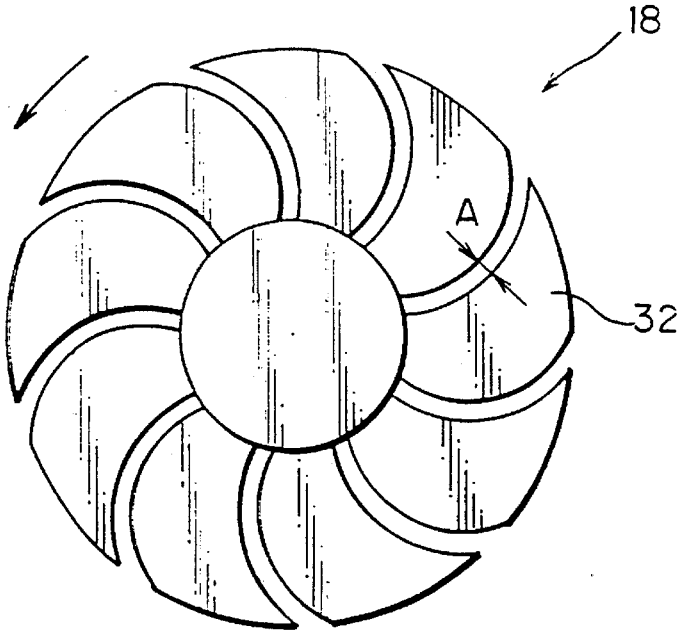

FIGS. 16 and 17, which are axial projected views, show modifications of the fans according to the present invention where the constant value of the gap A is maintained along the entire radial length of the fan blades. In FIG. 16, the number of blades 32 is seven, while, in FIG. 17, the number of blades 32 is nine.

In the first embodiment in FIGS. 1 to 17, the fan blade is a so-called sweep-forward blade, where the front edge 32-1 of the blade is forwardly inclined with respect to the direction of its rotation. However, the present invention can be applied to a different blade construction, such as a radial blade where its front edge extends radially about the axis of the rotation of the fan or a sweep-back blade where its front edge is inclined rearwardly with respect to the rotation of the fan.

Figure 18:
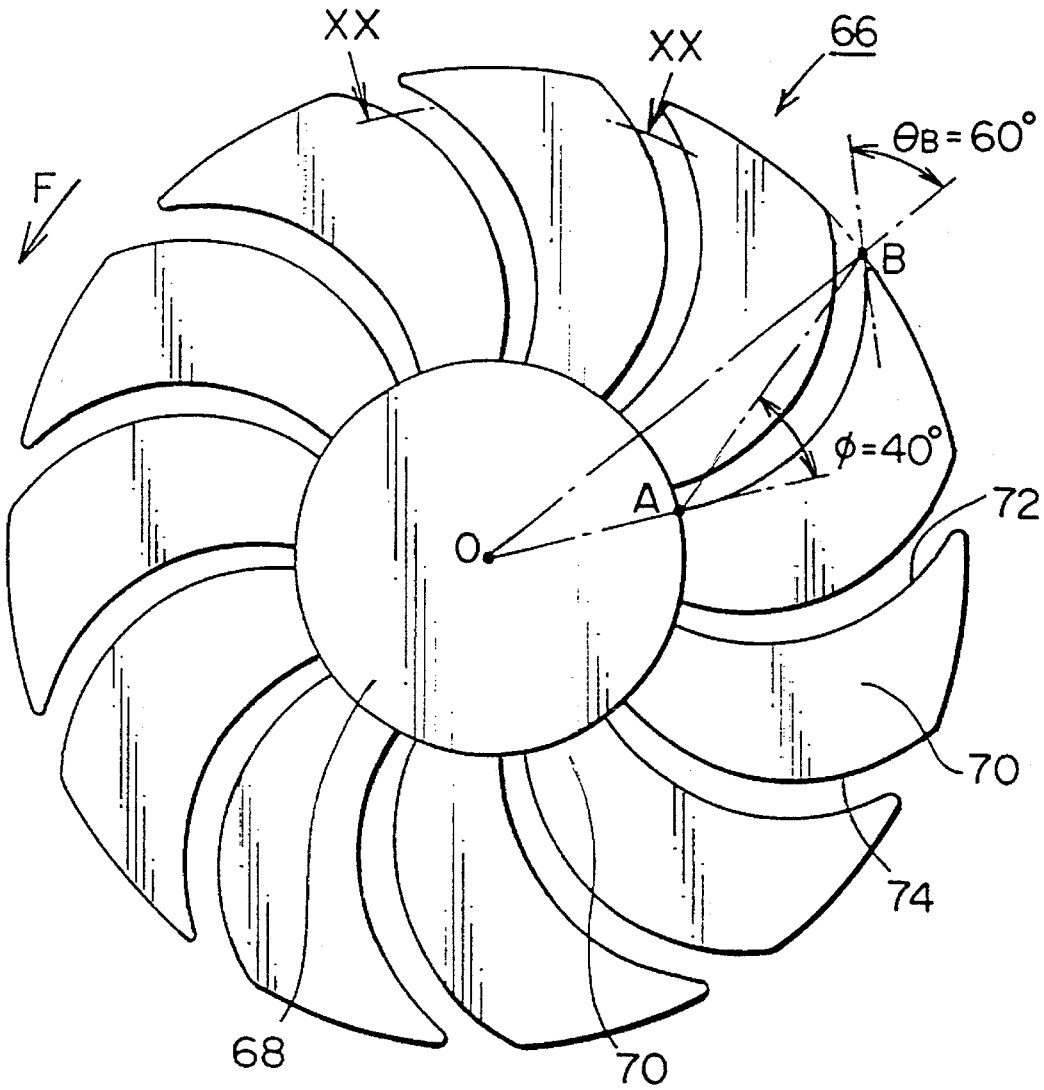
FIG. 18 is the same as FIG. 2 but illustrates a second aspect of the present invention.

Next, a second feature of the present invention, which is directed to suppression of the operating noise of the fan, will be explained. As shown in FIG. 1, the fan 18 which operates as a "pushing type fan" for creating or assisting air flow to the condenser 14, is adjacent to the front grills 16. Thus, a strong requirement has heretofore existed to reduce the operating noise of the fan 18 as much as possible. In order to attain this goal, a desired range of the number of blades 32 as well as a value of sweep-forward angle $\phi$ (FIG. 18) of the blade 32, is determined. FIG. 18 is quite similar to FIG. 2, but, is used for the explanation of this feature of the invention.

Figure 19:
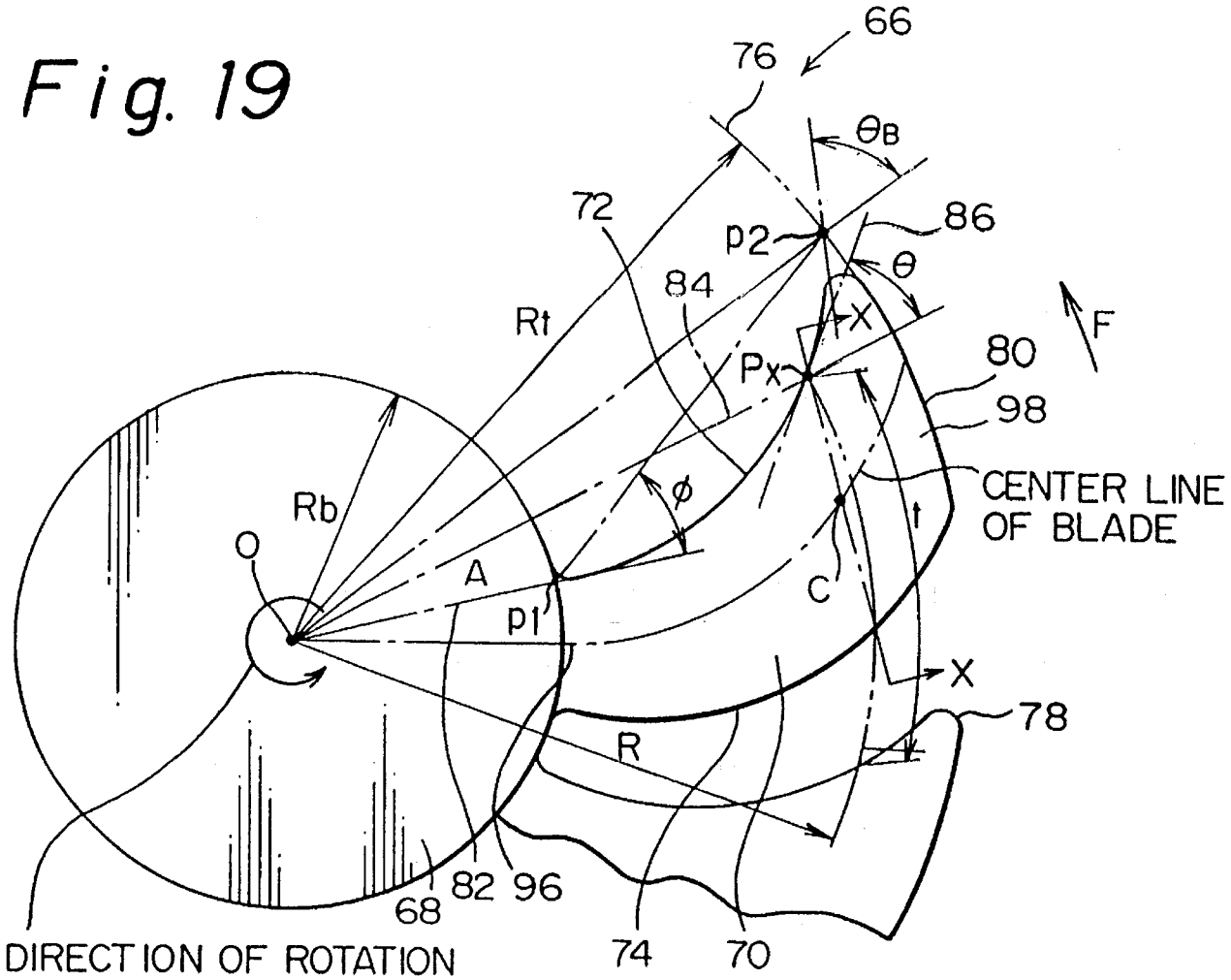
FIG. 19 is an enlarged partial view of the fan shown in FIG. 18.

As shown in FIG. 18, the fan 66 includes a boss portion 68 and a plurality (11 in this embodiment) of spaced, radially extending blades 70. Each of the blades 70 forms, as viewed on a projected plane along the axis of rotation, a circumferentially spaced front edge 72 and a rear edge 74 in a direction of the rotating movement of the fan 66. In the direction of the rotating movement F of the fan 66, both the front and rear edges 72 and 74 are curved forwardly. As shown in FIG. 19, the front curved edge 72 extends inwardly to the boss portion 68 and is connected thereto at a root point $p_1$, and extends outwardly toward a point $p_2$ located at the intersection of an outer trajectory 76 of the fan 66 and a continuation of front 72. Just before the point $p_2$, a rounded corner 78 is created for connecting the front edge 72 to a radial outward end surface 80 of the blade 70. A sweep-forward angle $\phi$ is defined by an angle between a line 82 connecting the axis O of the fan 66 and the root point $p_1$ and a line connecting the root point $p_1$ and a tip point $p_2$. An inclination angle $\Theta$ at a selected point $p_x$ on the front edge is an angle between a line 84 and a radial line 86 which is tangential to the edge 72 at the selected point $p_x$.

Figure 20:
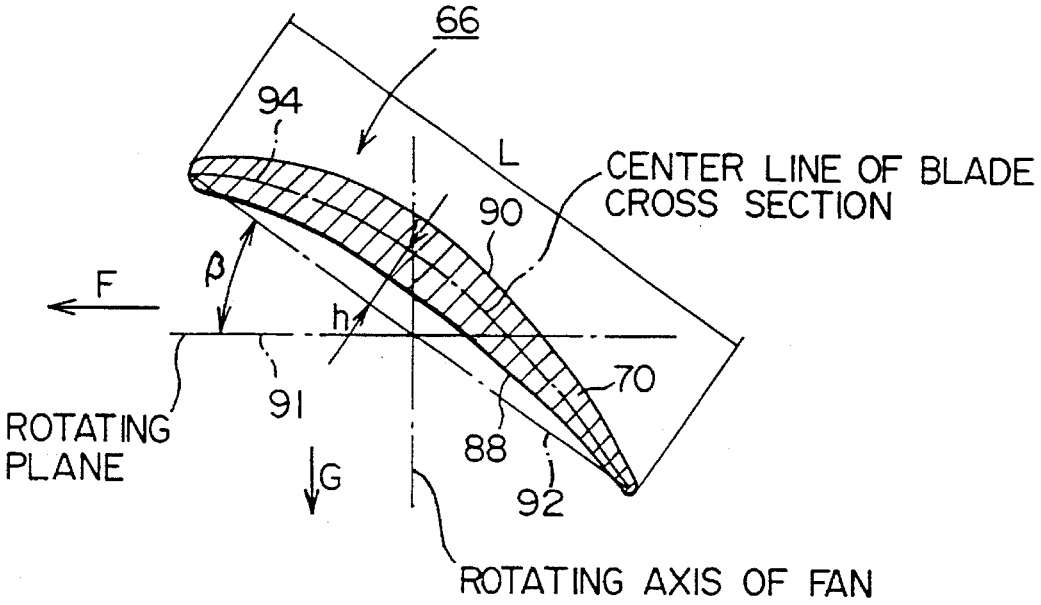
FIG. 20 is a cross-sectional view of a blade of the fan in FIG. 19.

As shown in FIG. 20, along the cross section at a radius from the axis O of the boss 68, each of the blades 70 forms a pair of spaced apart arc shaped front and rear edges 88 and 90 respectively, which are curved away from the direction F of the fan 66. Furthermore, the blade is forwardly inclined with respect to the direction F of the rotation of the fan 66, so that a rotating movement of the fan as shown by an arrow F causes a pushing flow of the air as shown by an arrow G to be created toward an object to be supplied, such as a condenser 14 in FIG. 1. In FIG. 20, a blade mounting angle $\beta$ is defined as an angle between the rotating plane 91 and a line 92 connecting the front and rear ends of a center line 94 of the blade 70. The length L, which is the distance between front and rear end of the fan, is referred as chord length, and h, which is the distance between the apex of a center line of the blade and a chord line 92.

Figure 21:
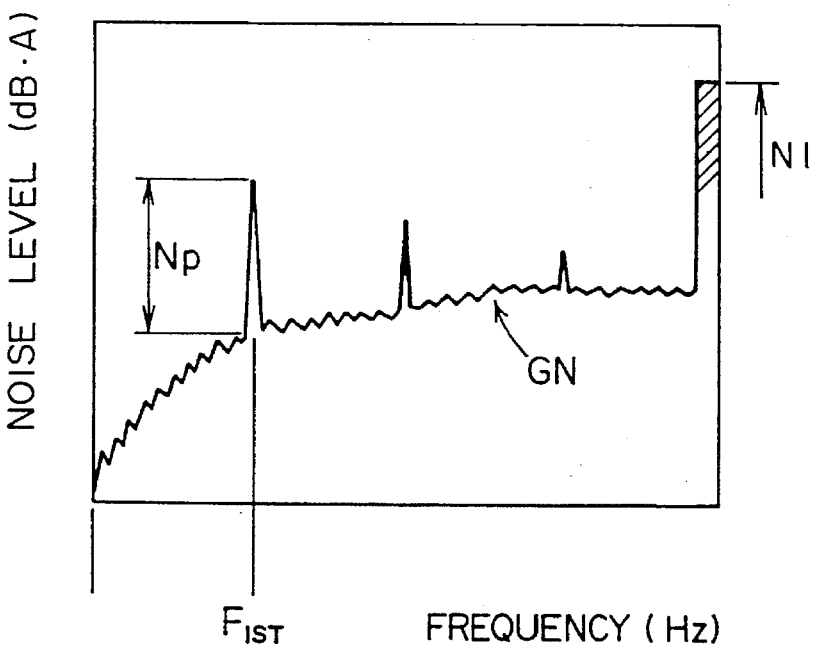
FIG. 21 shows the relationship between the frequency and the level of noise generated from the fan when it is rotating.

FIG. 21 shows a typical example of the operating noise generated from a conventional fan with respect to the frequency, and illustrates how an evaluation of the noise is done. Background noise is shown by a curve GN. An overall noise level throughout the frequency range is shown by $N_L$ is, which is, for a conventional fan, a value between 60 dB to 80 dB. A peak projected noise amount from the background level GN is expressed by $N_p$ at a rotating first order frequency $F_{1st}$. This rotating first order frequency in Hz is obtained by the rotational speed of the fan multiplied by the number of the blades divided by 60. For a typical conventional fan with 5 blades under the rotational speed of the fan of 2,000 r.p.m., the peak projected amount $N_p$ is about 20 to 30 dB at the first rotating order frequency $F_{1st}$ of 167 Hz.

An evaluation of the noise from a fan in the prior art is only done by the overall value of the noise $N_L$. However, a correct determination of whether the noise is such that it will cause someone to feel uncomfortable cannot be done by using only the value of the overall noise $N_L$, because in addition to the overall noise $N_1$, the peak projected amount $N_p$ as well as the frequency $F_{1st}$ for producing the peak has an effect on the determination. The higher the peak amount, the higher the degree of unpleasantness for the ears. Furthermore, the frequency $F_{1st}$ at the peak is related to the tone of the noise, which determines if the noise will cause discomfort.

In view of the above, in order to reduce a sensor noise from a fan, consideration should be given not only to the overall noise level $N_L$ but also to the peak projected amount $N_p$ as well as the rotating first order peak frequency $F_{1st}$. It is considered that the rotating first order component is generated due to a cyclic pressure change caused by the rotating movement of the fan. Thus, a suitable variable control of the cyclic pressure change can control the peak projected amount $N_p$ as well as the rotating first order peak frequency $F_{1st}$. Such a variable control of the cyclic pressure change can be done by a variable controlling of the rotational speed of the motor 20 (FIG. 2) for, operating the fan. However, such a variable control is not very effective for the motor 20 (FIG. 1) that is for driving the pushing type fan in an automobile. Namely, the motor 20 is regulated so that its rotational speed is designed to be controlled to a predetermined fixed value, such as 2,000 r.p.m. Thus, the efforts of the inventor in reducing the operating noise were directed to an improvement in the construction of the fan itself, that is the number of fan blades, which provides the best sensory noise reduction.

FIG. 22 illustrates, for fans of different numbers of blades as schematically illustrated, characteristics of the noise parameters including the peak frequency, the peak projected amount, and the overall noise level while maintaining a constant value of the diameter of the fans at 300 mm. As FIG. 22 shows, the larger the number of fan blades, the larger the overall noise level $N_L$. However, the larger the number of fan blades, the smaller the peak projected amount $N_p$. And, the larger the number of fan blades, the higher the first order noise peak frequency $F_{1st}$. As to the peak projecting amount, an increase in the number of the blades causes an increased sensory noise reduction evaluation, and the result will be a reduction in the overall noise level. Thus, it is predicted that an optimum value exists as to the number of blades which can harmonize the sensory noise reduction evaluation for both the peak projecting amount and the overall noise level.

In view of the above, a sensory noise reduction evaluation test of the number of the blades was conducted based on peak projecting amount $N_p$, the peak frequency $F_{1st}$ and the overall noise level $N_L$. For fans of different numbers of blades as shown in FIG. 22, a five grade evaluation was done by ten listeners, and the result of the sensory evaluation is shown in FIG. 23. FIG. 23 shows that the best results are obtained when the number of blades is eleven. However, the range of the number of the blades between 9 and 15 can also provide reduced noise in view of the sensory evaluation. This is the reason why the fan 66 in FIG. 18 has eleven blades.

Figure 25:
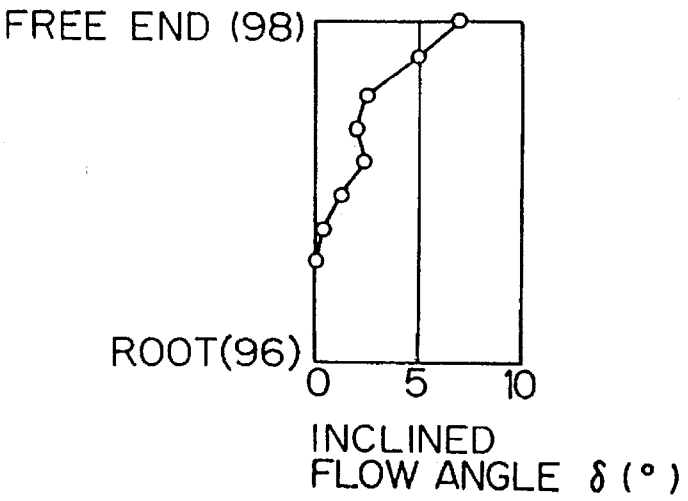
Fig. 25 PRIOR ART
FIG. 25 shows the relationship between inclined flow angle $\delta$ and the radial position of a blade of the fan in the prior art in FIG. 24.
Figure 24:
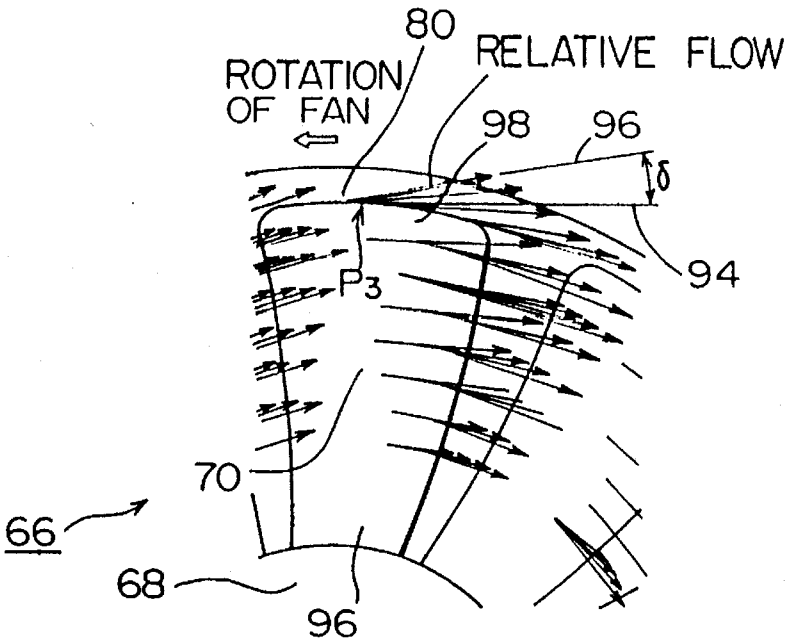
Fig. 24 PRIOR ART
FIG. 24 illustrates the condition of air flows at various radial positions on a blade of a fan in the prior art.

The selection of the number of the blades between 9 and 15 causes the overall noise level to increase slightly as shown in FIG. 22. Thus, a test has also been carried out by the inventors to provide a fan construction capable of suppressing the overall noise level. FIG. 24 shows a visual illustration of the flow of air at various locations adjacent the blade 70. In FIG. 24, line 94 is a line tangential to the outer trajectory of the blade at a location $p_3$, and line 96 shows the extended direction of the air flow at location $p_3$. An inclined flow angle $\delta$ is defined as an angle between the lines 94 and 96. Such an inclined flow angle $\delta$ is similarly defined for any desired radial positions along the radial position of the blade 70. FIG. 25 shows a relationship between the radial positions and the inclined flow angle $\delta$. As can be seen from FIG. 25, at the root portion 96 of the fan the value of the inclined flow angle $\delta$ is nearly zero. However, nearer to the free end 98 of the blade 70, the value of the inclined flow angle $\delta$ is larger. An ideal design for the axial flow fan is such that the value of the inclined flow angle $\delta$ is maintained substantially at zero along the entire radial positions. In other words, a value of the inclined flow angle $\delta$ larger than zero means that some irregularity has occurred in the air flow condition. Thus, the inventors considered that the increased noise generated by the fan is closely related to the inclined flow angle $\delta$ being larger than zero at the outer location of the blade. The inventors found that, in order to reduce the value of the inclined flow angle $\delta$, employment of the fan of the forward flow type as shown in FIG. 19 is advantageous, and the value of the forward movement angle $\phi$ is the key factor.

Figure 26:
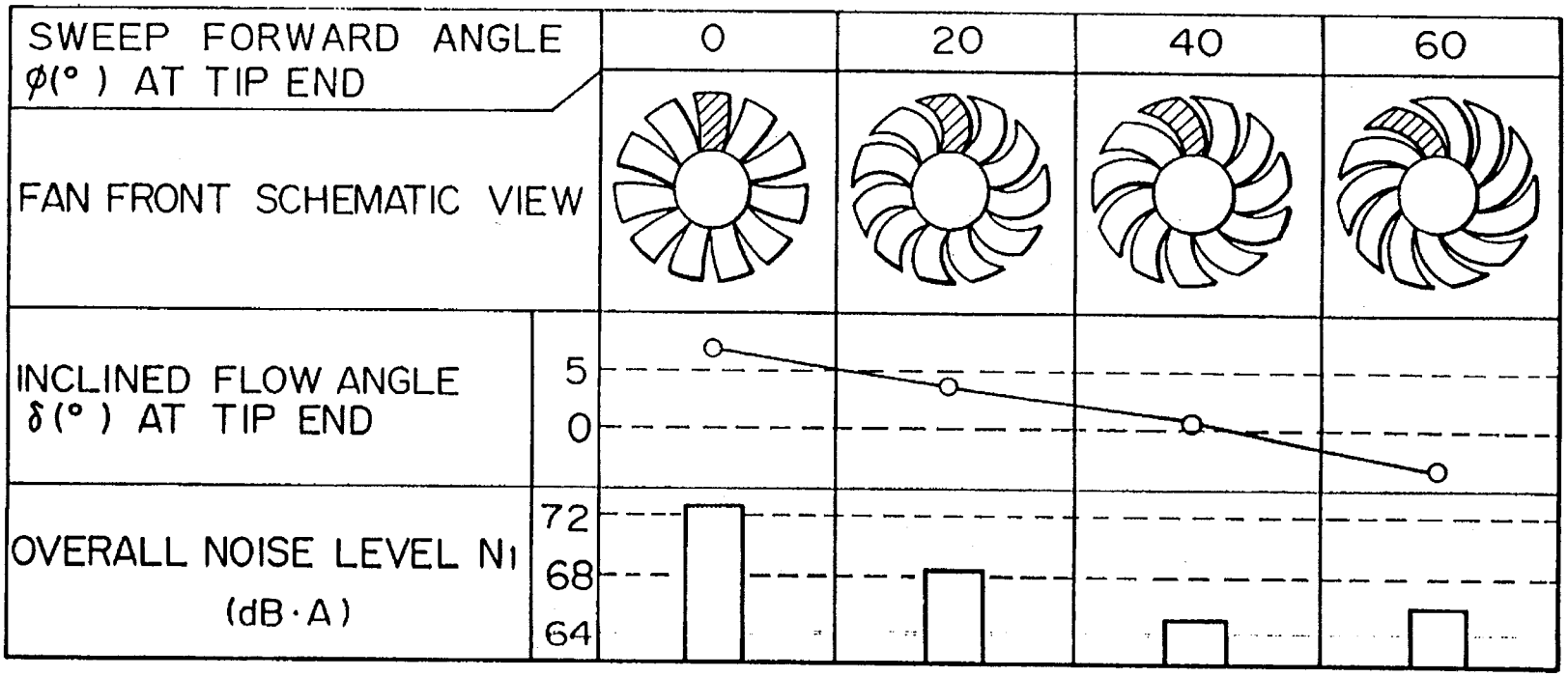
FIG. 26 shows front views of fans, inclined flow angle, and the overall noise level with respect to number of blades.

FIG. 26 illustrates fans with eleven blades, the sweep-forward angle $\phi$ measured at their tip or free ends of the respective blades (as schematically illustrated), measured values of the inclined flow angle $\delta$ at the tip or free ends of the respective blades and the overall noise level $p_1$. As can be seen, the larger the value of the sweep-forward angle $\phi$, the smaller the value of the inclined flow angle $\delta$. When the fan has a value of the sweep-forward angle $\phi$ around 40 degrees, the value of the inclined flow angle $\delta$ is reduced to zero. Furthermore, when the value of the sweep-forward angle $\phi$ is increased to 60 degrees, the value of the inclined flow angle $\delta$ becomes lower than zero, i.e., a minus value. Furthermore, the maximum reduction of the overall noise level reduction is obtained when the value of the inclined flow angle $\delta$ is around zero, i.e., when the fan has a sweep-forward angle $\phi$ of around 40 degrees.

In short, the most effective reduction of the overall noise level $p_L$ can be obtained when the value of the inclined flow angle $\delta$ is around zero which is obtained by the sweep-forward angle $\phi$ being around 40 degrees at the free end of the blade. In comparison with the fans with the inclined flow angle $\delta$ of 20 and 60 degrees in FIG. 26, it is considered that the sweep-forward angle $\phi$ should be in a range between 30 and 50 degrees, and preferably in a range between 35 to 45 degrees. In view of this experimental result, in the embodiment in FIG. 18, the value of the sweep-forward angle $\phi$ is selected to be 40 degrees.

The above discussion is directed to a control of the inclined flow angle $\delta$ of zero degrees at the free end of the blade. However, the blade must have a shape which can obtain the inclined flow angle $\delta$ of zero degrees along the entire area of the blade from the root position 96 (FIG. 24) to the free end position 98. In order to do this, the inventors have focused on the fact that in a fan with a sweep-forward angle $\phi$ of 40 degrees, the value of the inclined flow angle $\delta$ is gradually increased nearer the free end 98 of the blade. In conformity with the gradually increasing value of the inclined flow angle $\delta$ toward the free end of the blade as shown in FIG. 25, the shape of the blade is such that the value of the inclination angle $\Theta$ shown in FIG. 19 at a radial location $p_x$, gradually increases from the root portion 96 to the tip end portion 98.

Figure 28:
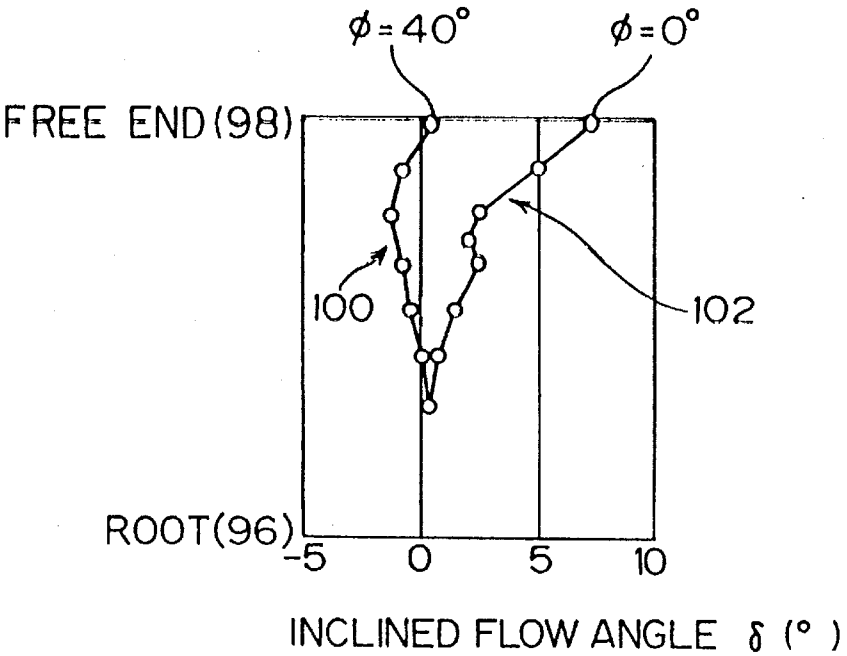
FIG. 28 shows the relationship between inclined flow angle $\delta$ and the radial position of a blade of the fan in FIG. 27.
Figure 27:
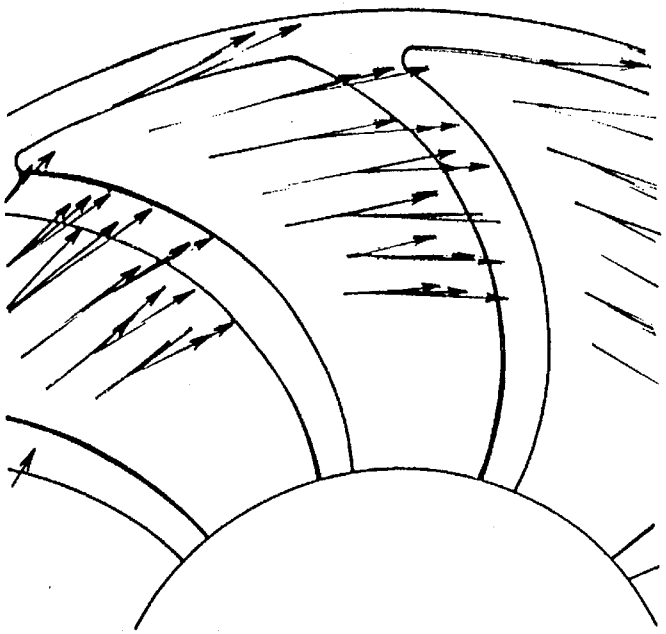
FIG. 27 is similar to FIG. 25 but illustrates the condition of the air flows at various radial positions on a blade of a fan.

A visual air flow test was carried out for the above construction of the fan blade and is schematically illustrated in FIG. 27. In FIG. 28, a curve 100 shows measured values of the inclined flow angle $\delta$ at various radial positions of the blade from the root portion 96 to the free end portion 98 when the value of sweep-forward angle $\phi$ of the blade is 40 degrees. In comparison, a curve 102 shows the measured values of the inclined flow angle $\delta$ when the value of sweep-forward angle $\phi$ of the blade is 0 degrees.

Furthermore, the inventors have found that in order to reduce the values of the inclined flow angle $\delta$ along the radial positions of the blade 70 and thereby obtain a substantial reduction in the overall noise $N_L$, the blade 70 should be arranged such that, when the value of sweep-forward angle $\phi$ of the blade is 40 degrees, the value of the inclination angle $\Theta$ as shown in FIG. 19 at the front edge 72 of the blade has a smaller value at the root portion 96 and a larger value at the free end portion 98. This is effective in obtaining a zero value of the inclined flow angle $\delta$ along the entire radial positions thereof, and thereby reduces the overall noise. This condition is illustrated by a curve 104 in FIG. 29.

Figure 29:
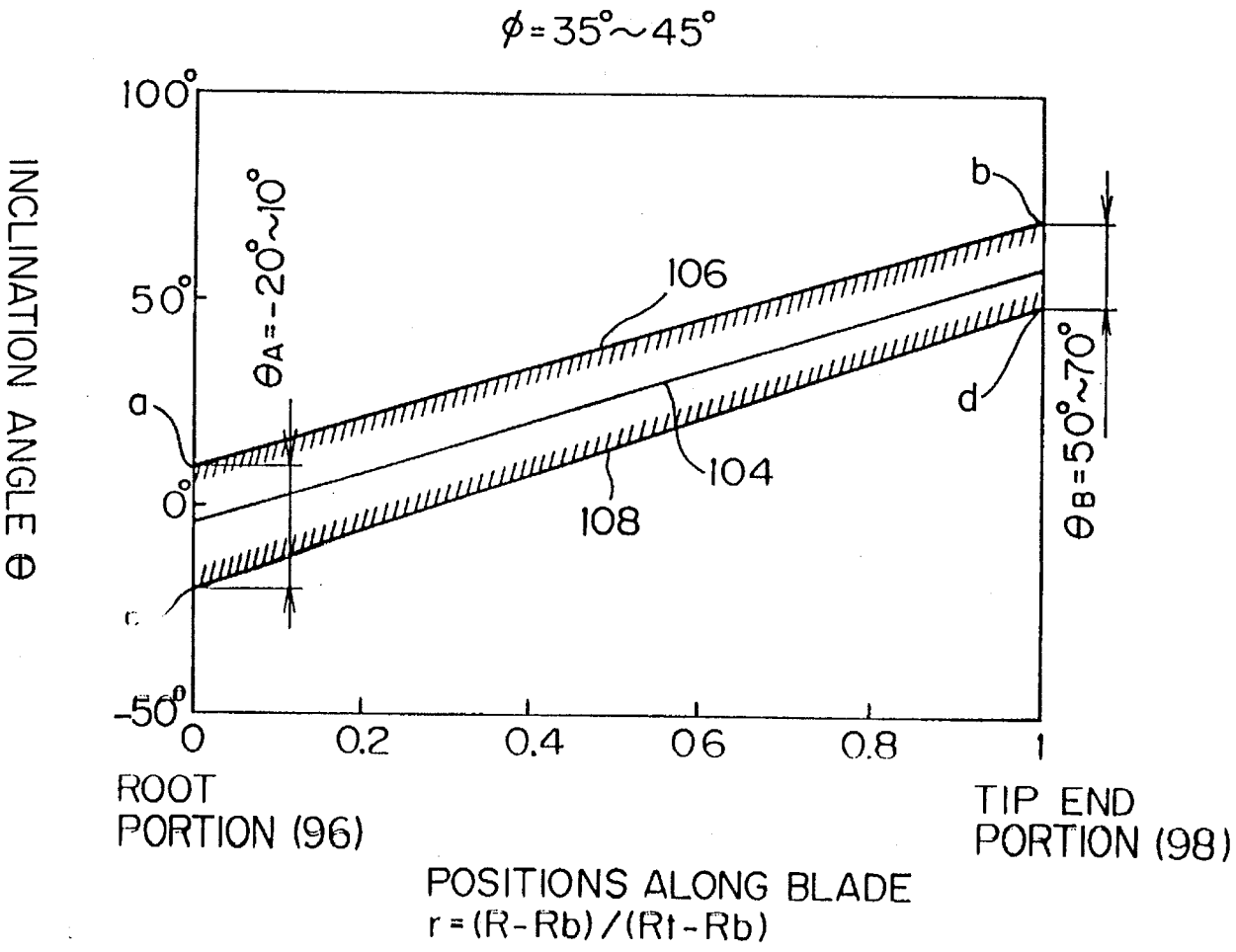
FIG. 29 depicts the relationship between non-dimensional radial position and the inclination angle $\Theta$ of the fan.

As shown in FIG. 29, a linear relationship should desirably exist between the radial positions of the blade 70 and the inclination angle Θ. As shown by the curve 104, the value of the inclination angle Θ is about zero degrees at the root portion 96, gradually and continuously increases, and is about 50 degrees at the tip end portion 98. Curves 106 and 108 show permissible upper and lower lines, respectively, which are within 10 degrees from the idealized curve 104. The inclination angle $\Theta_A$ at the forward edge 72 of the blade can have a range between −20 degrees (c) to 10 degrees (a) at the root portion of the blade. The inclination angle $\Theta_B$ have a range between 50 degrees (c) and 70 degrees (b) at the tip portion of the blade. Namely, a test carried out by the inventors has affirmed that a value of the inclination angle Θ within a range between the curves 106 and 108 can provide a measured value of the inclined flow angle 8 which is near zero.

In short, the fan 66 according to the present invention with 11 blades 70 of the forward flow type, having a sweep-forward angle Θ of about 40 degrees, and having an inclination angle Θ of a smaller value at the root portion 96 and a higher value at the tip end portion 98 can reduce the overall noise level while obtaining an improved sensory evaluation of noise reduction.

Figure 30:
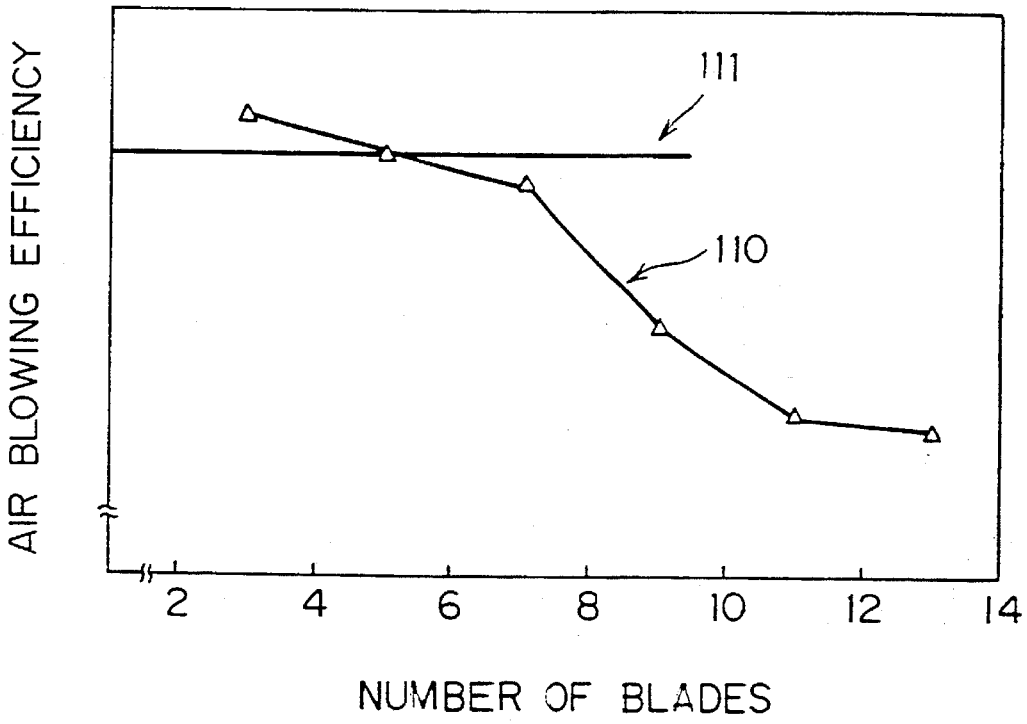
FIG. 30 shows the relationship of the number of blades to air blowing efficiency in the fan.

The inventors have further found that the increased number of blades can reduce the air blowing efficiency as shown in FIG. 30, and a curve 111 shows the blowing efficiency of a conventional fan with five blades. In FIG. 30, a curve 110 shows the relationship between the number of blades 70 and the air blowing efficiency. This curve 110 is obtained by using fans with different numbers of sweep-forward blades according to the present invention, while the bending ratio h/l in FIG. 20, the mounting angle β and the solidity as a ratio of the chord length l to the pitch length t (FIG. 19) between adjacent blades 70 are maintained the same as those found in the fan of the prior art construction. In short, the increased number of the blades can reduce the blowing efficiency when the cross-sectional shape of the blades is maintained the same as the prior art. Thus, the inventors have conducted further tests to obtain a desired blade shape in its cross-sectional shape. The details of a method for conducting these tests are disclosed in Japanese Patent Application No. 3-338667. Five samples A to F of the fans are prepared, which have the same value of the bending ratio h/l at the tip portion 98, and have different values of bending ratio $h/l_b$ at the root portion 96. These values are 4%, 8%, 10%, 12%, 14% and 16% respectively In FIG. 31, curves $\mathbf{112}_A$ to $\mathbf{112}_F$ show distributions of the bending ratio h/l for fan samples A to F at respective non-dimensional radius r of the cross section expressed by $$r = \frac{R - R_b}{R_t - R_b}$$

As shown in FIG. 19, R is the radius at the selected position $p_x$, $R_b$ is the inner radius of the blade and $R_t$ is the outer radius of the blade.

Figure 32:
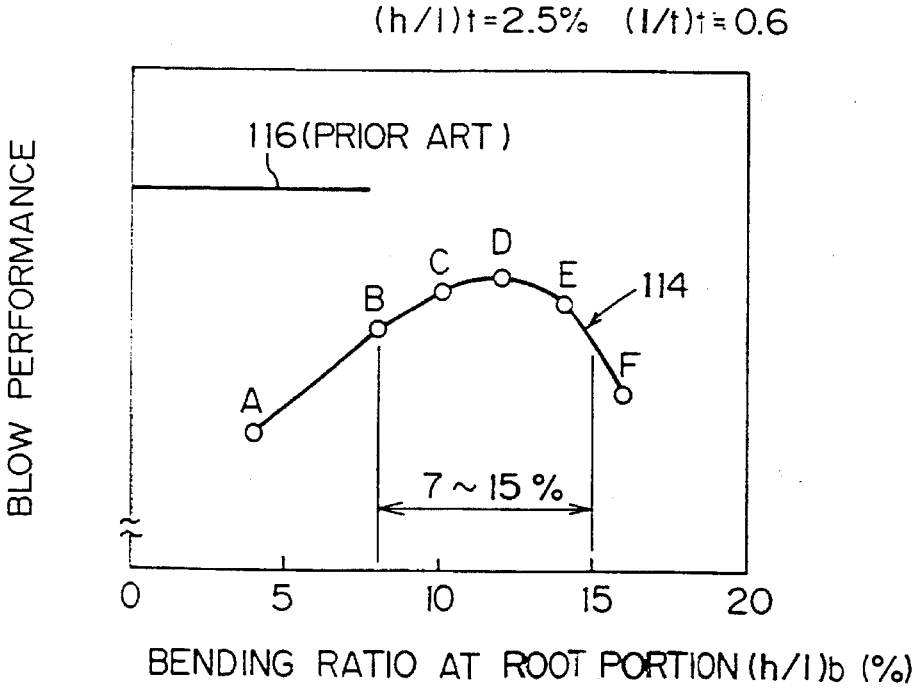
FIG. 32 shows the relationship between bending ratio and air blowing efficiency at the root portion of the fan blade.

In FIG. 32, a curve 114 shows a relationship between a bending ratio at the root portion of the blade $(h/l)_b$ and the blowing performance. As shown in FIG. 32, a range of values of the bending ratio $(h/l)_b$ between 5% and 15% can increase the blowing performance, and the maximum improvement was obtained when the bending ratio is about 12%. In FIG. 32, a line 116 shows the blowing performance of a conventional fan with five blades. This means that according to the present invention a fan with 11 blades is insufficient in view of the blowing performance, since the blowing performance of the fans A to F is always inferior with respect to that of the prior art fan (116) with 5 blades.

The inventor found that a reason for the reduced blowing performance in the fan with eleven blades is due to the fact that the fan with 11 blades can necessarily reduce the chord length l. Namely, an increase in the number of the blades causes the chord length to be reduced, while maintaining a constant value of the solidity l/t. Thus, an increase in the number of the blades must be harmonized with the inevitable reduction of the chord length. Such a harmonization is attained according to the present invention in the following manner.

Namely, a rotating movement of a fan causes an air flow to be created and a pressure difference to be created across the fan. In the case of the pushing type fan as shown in FIG. 1, a large pressure difference is created across the fan. This difference is enough to cause the air flow from the fan to be directed to the condenser 14 and the radiator 12.

Next, a difference in the performance between a first fan with a larger number of blades with smaller chord lengths and a second fan with a smaller number of the blades of larger chord lengths is analyzed. Assuming that the first fan and the second fan have the same radius and that the amount of air flow is the same, the pressure difference across the first and second fans must be the same. When the pressure difference across the fan is the same between the first and second fans, the first fan with blades with smaller chord length must provide a pressure gradient which is larger than that of the second fan with blades with longer chord length. The larger pressure gradient would cause the air flow on the surface of the blades to be easily separated therefrom. Such a separation of the air flow from the surface of the fan blades necessarily causes the fan efficiency to be reduced. This is the reason for the reduction in the air blowing performance of the fan with the smaller chord length.

In order to prevent the reduction in the air blowing efficiency of the fan with the larger number of the blades, it is essential to increase the chord length l. According to the present invention, such an increase in the chord length l, while maintaining the large number of the blades, is realized by increasing the value of the solidity. This is a ratio of the blade length l to the blade pitch t over the value of the solidity in the prior art fan, which is slightly smaller than 0.6.

Figure 33:
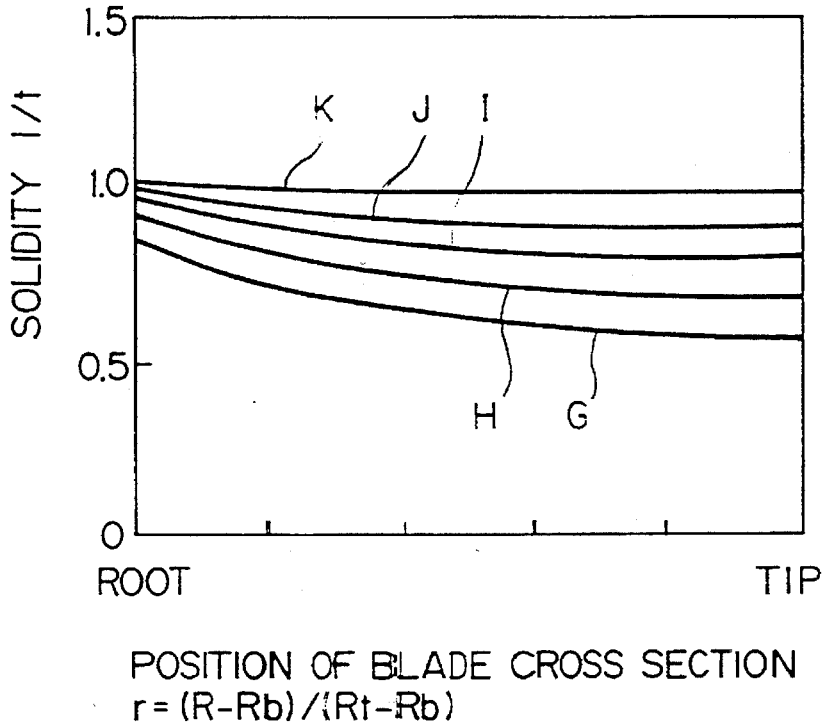
FIG. 33 shows various characteristics between non-dimensional radial position and solidity in the fan.
Figure 34:
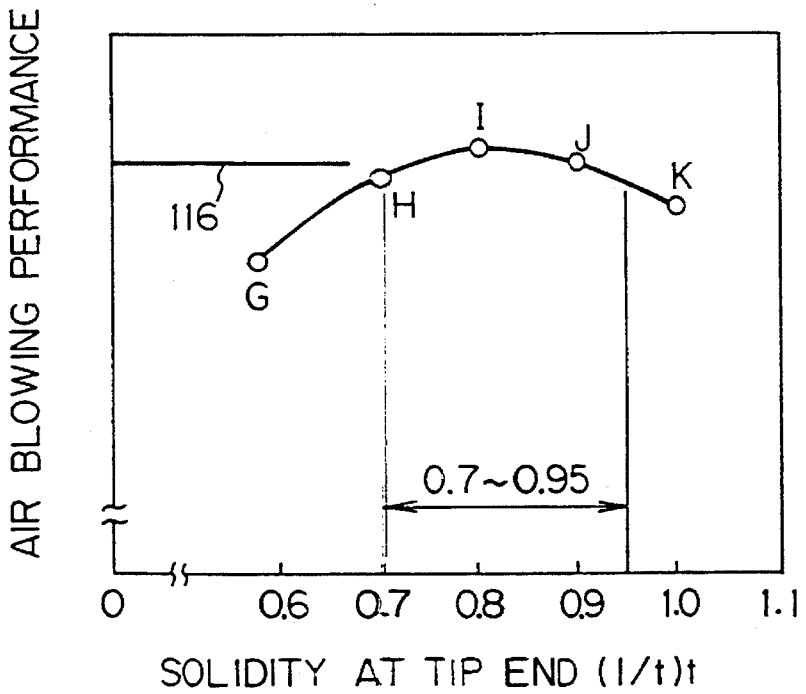
FIG. 34 shows a relationship between solidity at a tip end of the blade and the air blowing efficiency.

The inventors have prepared, with regard to a fan with eleven blades, five samples of fans G to K with different curves of solidity. As shown in FIG. 33, these samples have, at the respective tip end portions, values of solidity which are 0.58, 0.7, 0.8, 0.9 and 1.0, respectively. FIG. 34 shows a relationship between the values of the solidity at the blade tip end and the blowing performance. The value of the solidity between 0.7 to 0.95 can provide an air blowing performance which is comparable with that obtained by the prior art five blade fan shown by the line 116 in FIG. 34.

Figure 31:
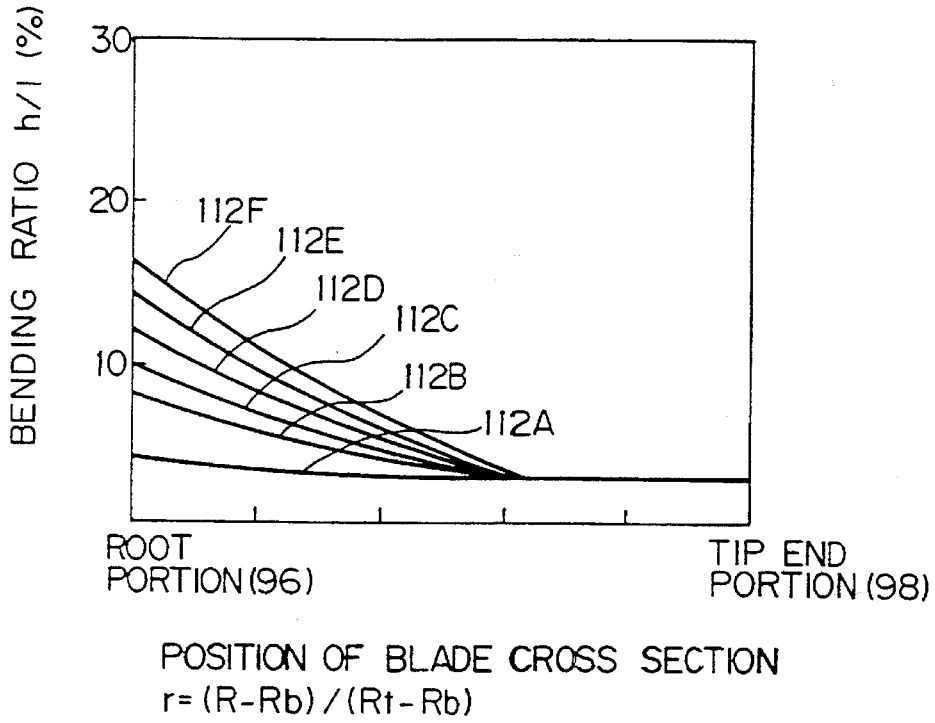
FIG. 31 shows relationships between the non-dimensional cross-sectional position of blade cross-sections and the bending ratio h/l of the fan.

According to the above feature of the present invention, a low noise fan with eleven forward moving type fan blades can provide a blowing efficiency which is comparable to a conventional 5 blade fan by providing a distribution of the bending ratio h/l which increases rapidly from the middle portion of the blade to the root portion 96 of the blade as shown in FIG. 31, by providing a distribution of the solidity l/t which is constantly or smoothly reduced from the root portion to the tip portion of the blade as shown in FIG. 33, and by obtaining values of solidity at tip portion of the fan between 0.7 to 0.95 as shown in FIG. 34. It should be noted that the distribution of the bending ratio need not necessarily be continuously reduced from the root portion to the middle portion of the blade as shown in FIG. 31. It may be possible that the characteristic curve of the bending ratio can have, at the root portion, a substantially constant value portion.

Furthermore, the curve of the bending ratio may have a portion which increases slightly from the middle portion to the tip portion of the blade. A slight modification in the characteristic curve of the bending ratio along the length of the blade can provide substantially the same degree of blowing performance.

Figure 35:
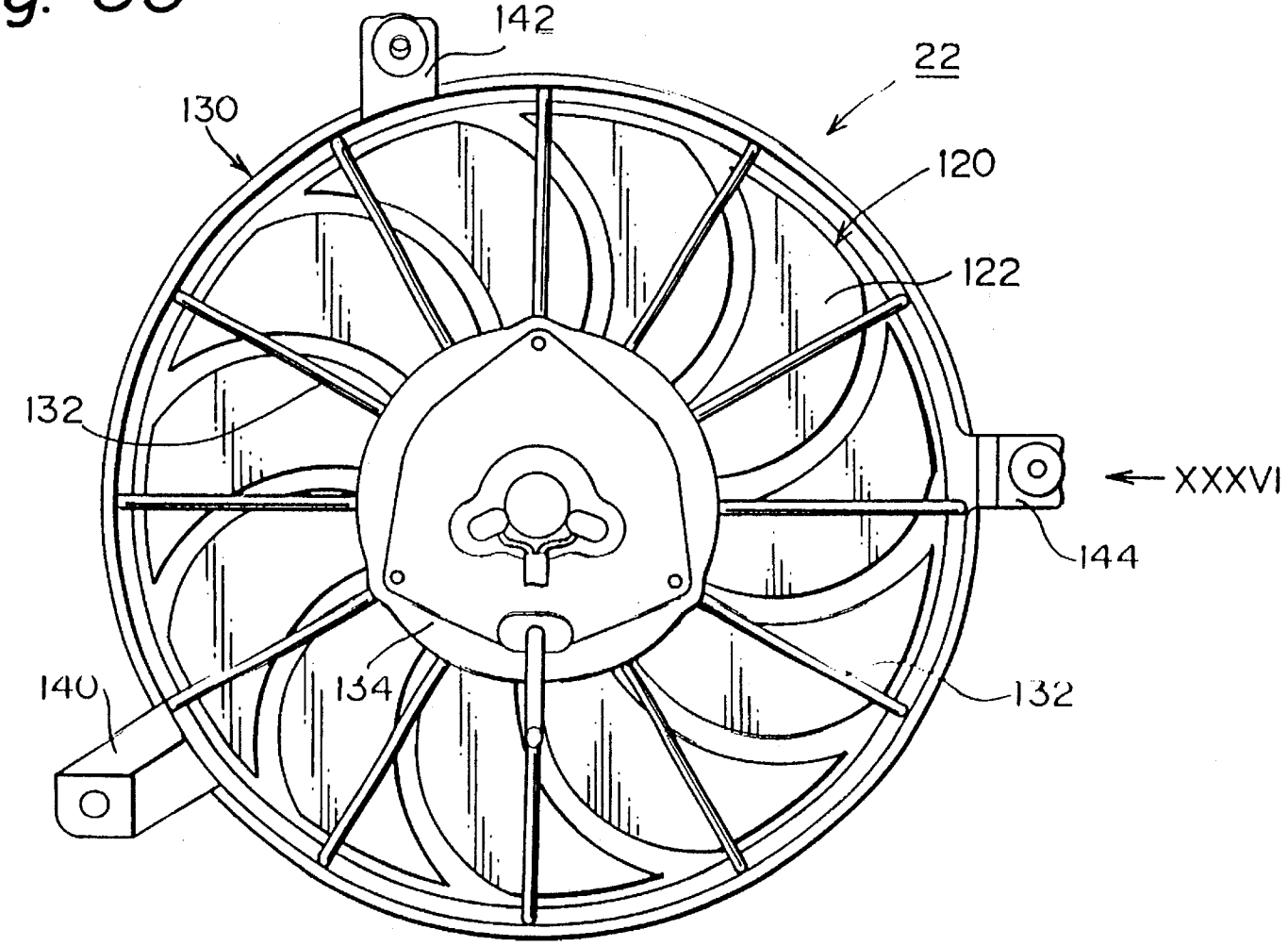
FIG. 35 is a front view of a fan according to the present invention together with an electric motor for operating the fan and a stay assembly for supporting the motor.
Figure 36:
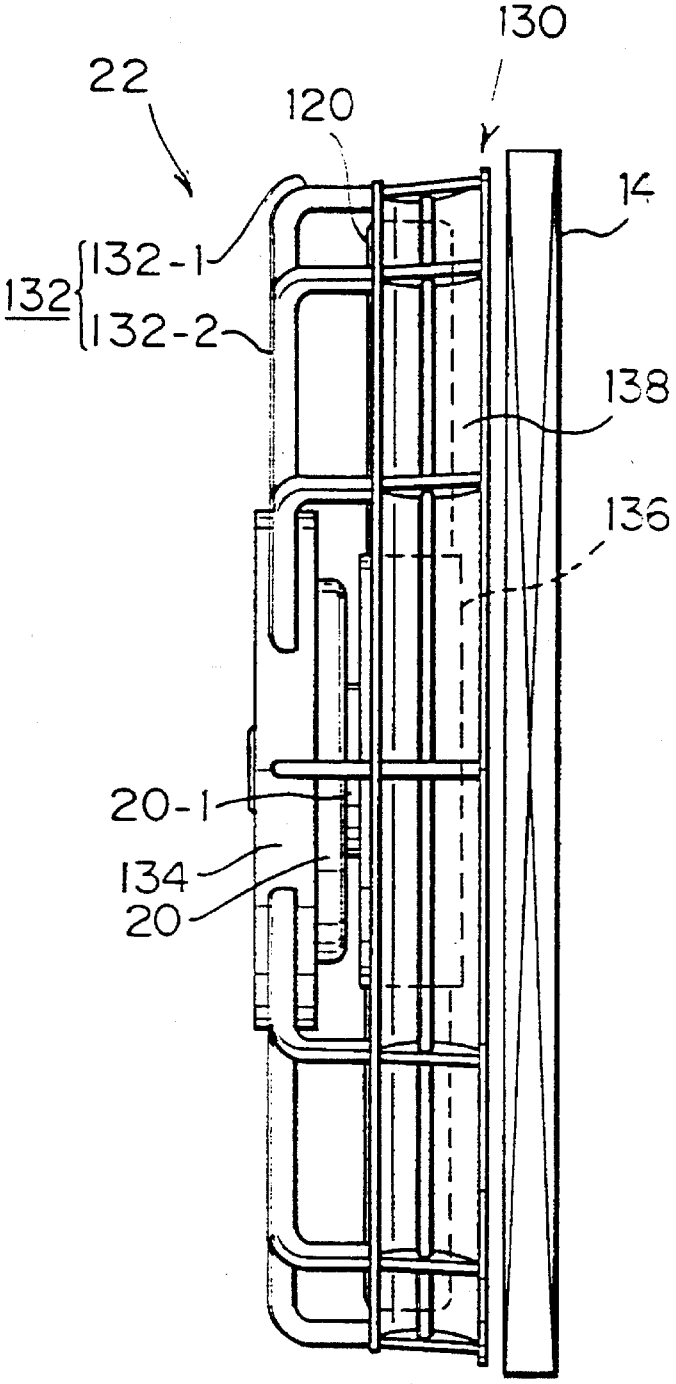
FIG. 36 is a side view taken along a line XXXVI in FIG. 35.

The present invention is also concerned with a detailed construction of the stay assembly 22 (FIG. 1) which is used for supporting the fan and can reduce noise which is generated due to the interference between the fan and stay assembly 22. In FIG. 35, a fan 120 may have the same construction as explained in the previous embodiments or the same construction as in the prior art. The fan 120 has blades of a desired number y, which is shown in the embodiment as eleven blades. Similar to the embodiment in FIG. 1, the fan 120 is arranged in front of the condenser 14 as shown in FIG. 36. The stay assembly 22 made as a molded resin is constructed using a shroud 130 which is arranged around the fan 120 and a plurality of equiangularly spaced stay members 132 of a number x, shown in the embodiment as twelve. As shown in FIG. 36, each of the stay members 132 is formed as an angled rod having a first section 132-1 extending integrally and horizontally from the shroud member 120, and a second section 132-2 extending vertically and inwardly to an outer housing 134 of the electric motor 20. The motor has a rotating shaft 20-1 connected along the axis of the fan 120 for rotating the fan 120 for a rotating speed of $N_f$ per minute. FIG. 35 shows that the stay assembly 22 is formed with lugs 140, 142 and 144 for connecting the assembly 22 to a suitable location in the engine room.

It should be noted that the number x (12 in the shown embodiment) of the stays 132 and the number y (11 in the shown embodiment) of the blades cannot be divided by each other. Furthermore, the electric motor 20 rotates the axial flow fan 120 at 2,000 revolutions per minute. Finally, in order to obtain a peak frequency of the interference noise greater than 4 KHz between the blades 122 of the fan 120 and the stay members 132 of the stay assembly 22, the number x of the stay members 132 is twelve and the number y of the blades 122 is eleven. In the shown embodiment, the following equation is obtained, $$\frac{x \times y \times N_f}{60} > 4{,}000,$$

where $N_F$ is the rotational speed of the fan.

Similar to the previous embodiment, the fan 120 has a boss portion 136 from which the equiangularly spaced blades 122 radially extend.

The rotating movement of the shaft 20-1 of the motor 20 causes the fan 120 to be rotated at a speed of 2,000 r.p.m. The rotating movement of the fan 120 causes air to be sucked through the stay 22 and into the shroud 130. The air flow is then directed to the heat exchanging device, such as the condenser 14 in this embodiment. A turbulence is created in the air flow when the air flow passes between the stay members 132. When the flow with the turbulence reaches the rotating fan 120, the turbulence in the air flow generated by the stay members 132 causes an interference noise to necessarily be created. According to this embodiment, the number x of the stay members 132, which is 12, and number y of the blades 122, which is 11, are in a relationship such that they cannot be divided by each other. Thus, the least common multiple between x and y is as large as 12×11=132. Furthermore, if the rotational speed $N_f$ of the axial flow fan 120 is 2,000 r.p.m., the peak frequency becomes $$f = \frac{x \times y \times N_f}{60} = \frac{12 \times 11 \times 2000}{60} = 4{,}400\ (hz)$$

Figure 37:
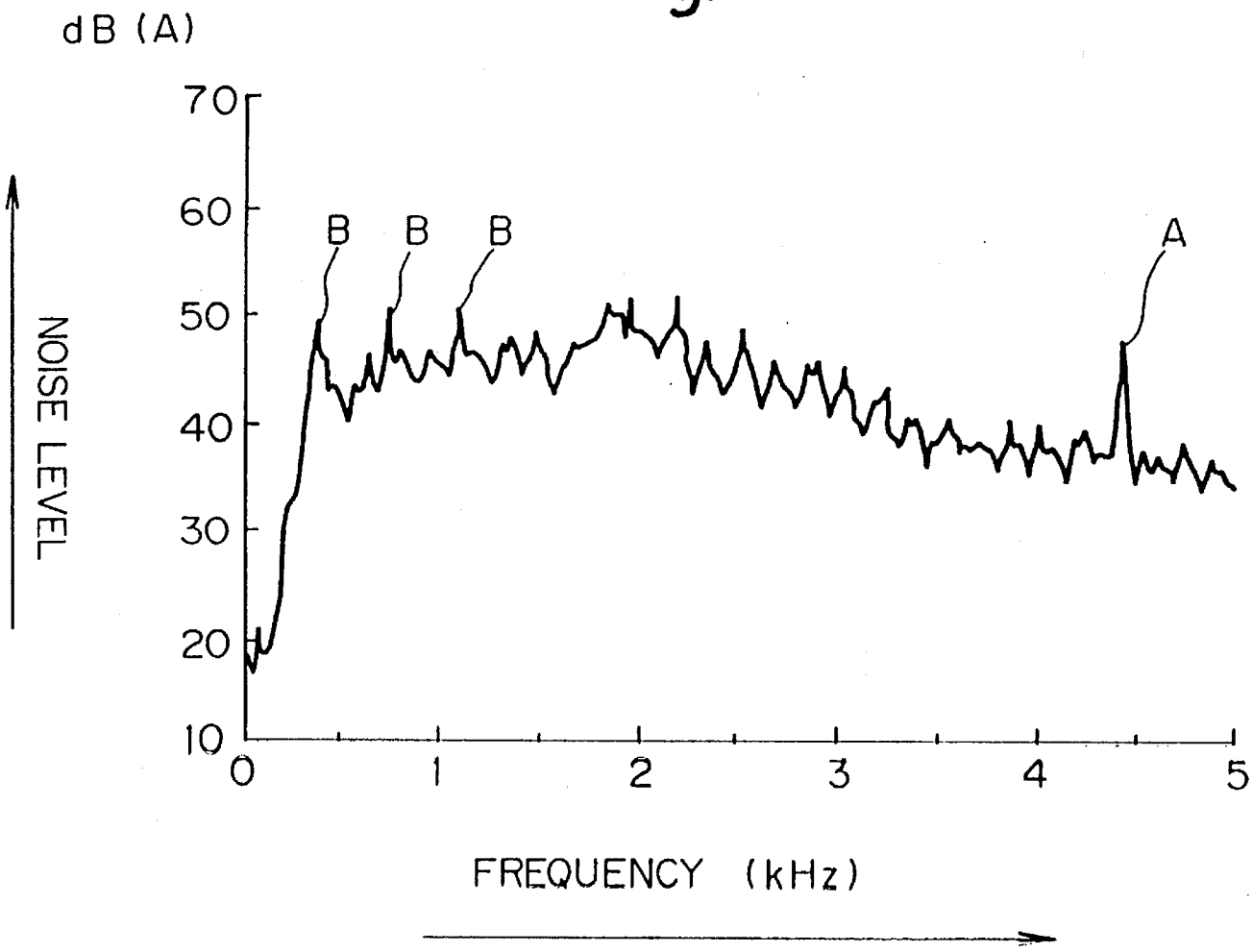
FIG. 37 is a relationship between the frequency and the noise level for the fan according to the present invention in FIG. 36.

As shown in FIG. 37, the basic peak frequency A of an interference noise between the blades 122 and the stays 132 becomes 4.4 KHz. It should be noted that, in FIG. 37, the small peaks B are those obtained due to the fan 120 rotating through the air.

As shown in FIG. 37, the peak frequency of noise A caused by the interference between the fan blades 122 and the stay members 132 is 4.4 KHz. This is advantageous because it is believed that a frequency higher than 2 KHz is less audible for a human being. Thus, the peak frequency of 4.4 KHz, in view of actually audible level, is reduced to the same level as that of other types of noise. According to the present invention, the noise is less uncomfortable and the noise at the peak frequency of the interference noise is audibly blocked by the other types of noise. Thus, a reduced noise can be obtained.

Figure 38:
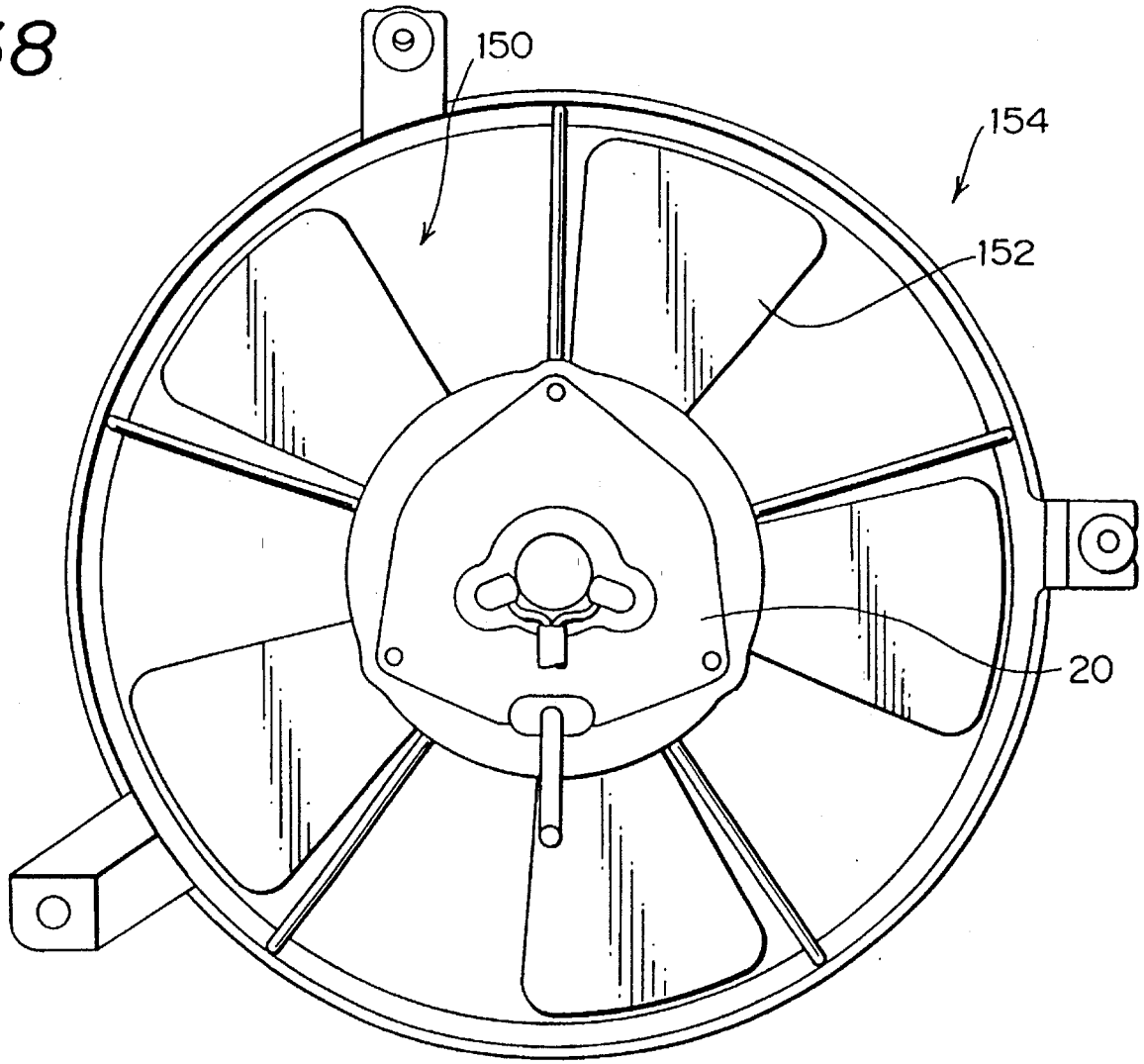
Fig. 38 PRIOR ART
FIG. 38 is similar to FIG. 35 but illustrates a construction in the prior art.
Figure 39:
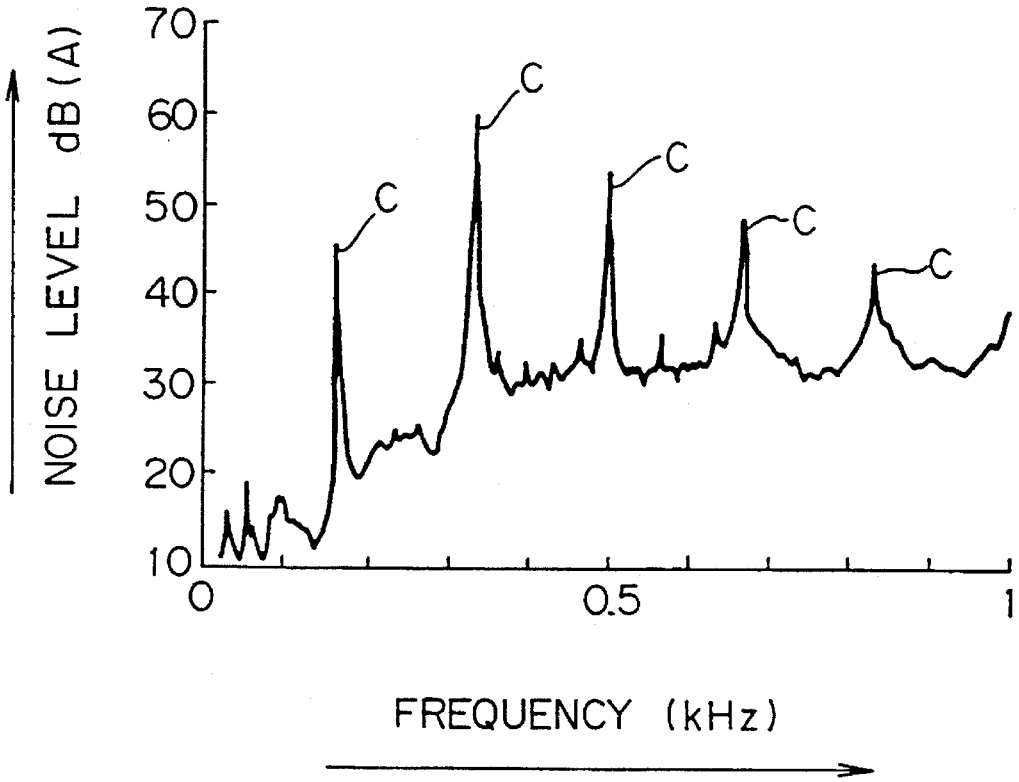
Fig. 39 PRIOR ART
FIG. 39 is similar to FIG. 37 but illustrates a relationship between the frequency and the noise level for the fan in FIG. 38.

FIG. 38 shows an example of a prior art, where the fan 150 includes five equiangularly spaced blades 152, while a stay device 154 includes five equiangularly spaced stays 103 for supporting the motor for driving the fan 150. Similar to the present invention in FIG. 35, the rotational movement from the motor 20 is transmitted to the fan 150, so that a turbulence is created in the air flow downstream from the stay 154. The turbulence in the air flow induced by the stay 154 causes an interference noise to be created. In a case where the rotational speed of the fan 150 is 2,000 r.p.m., a relationship between the frequency and the noise generated is as shown in FIG. 39. As can be seen in FIG. 39, the basic peak frequency is about 167 Hz, and peaks appear at frequencies corresponding to a multiple of the basic frequency as shown by C in FIG. 39.

Figure 40:
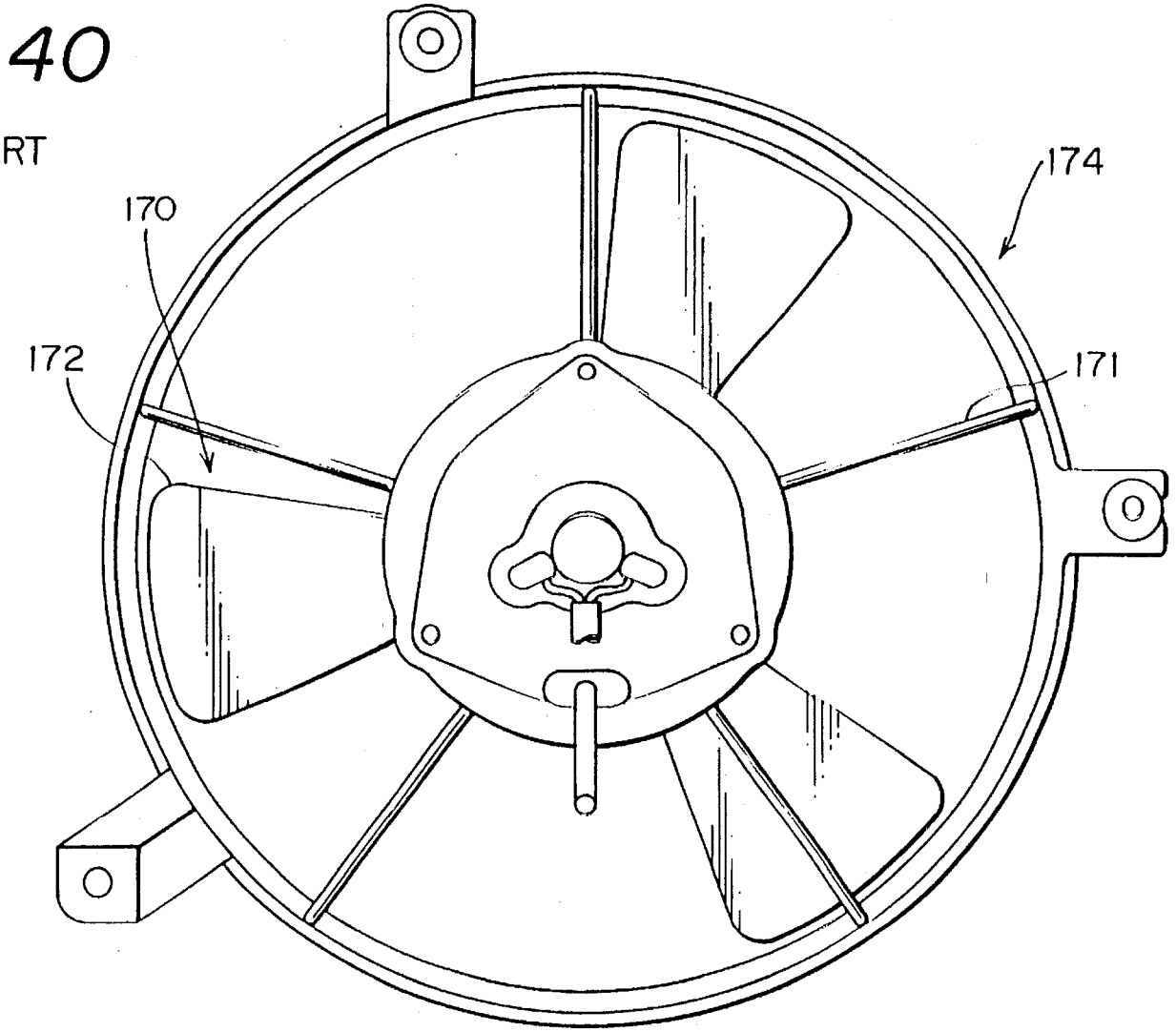
Fig. 40 PRIOR ART
FIG. 40 shows another construction from the prior art.
Figure 41:
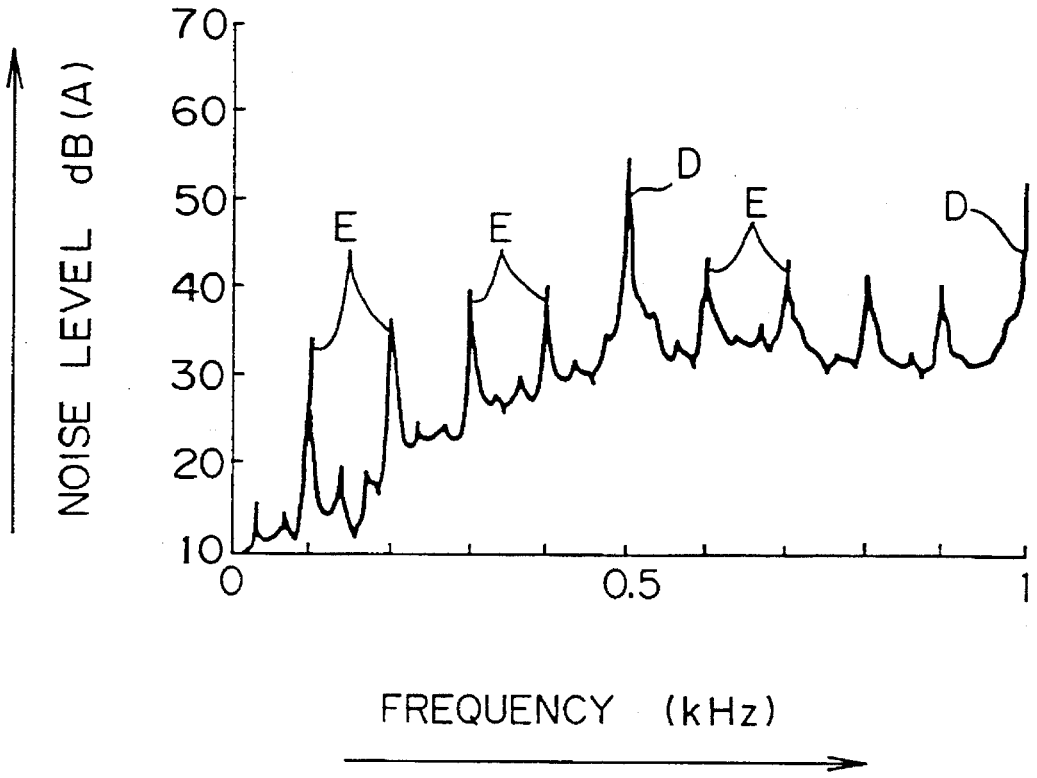
Fig. 41 PRIOR ART
FIG. 41 illustrates the relationship between the frequency and the noise level for the fan in FIG. 40.
Figure 42:
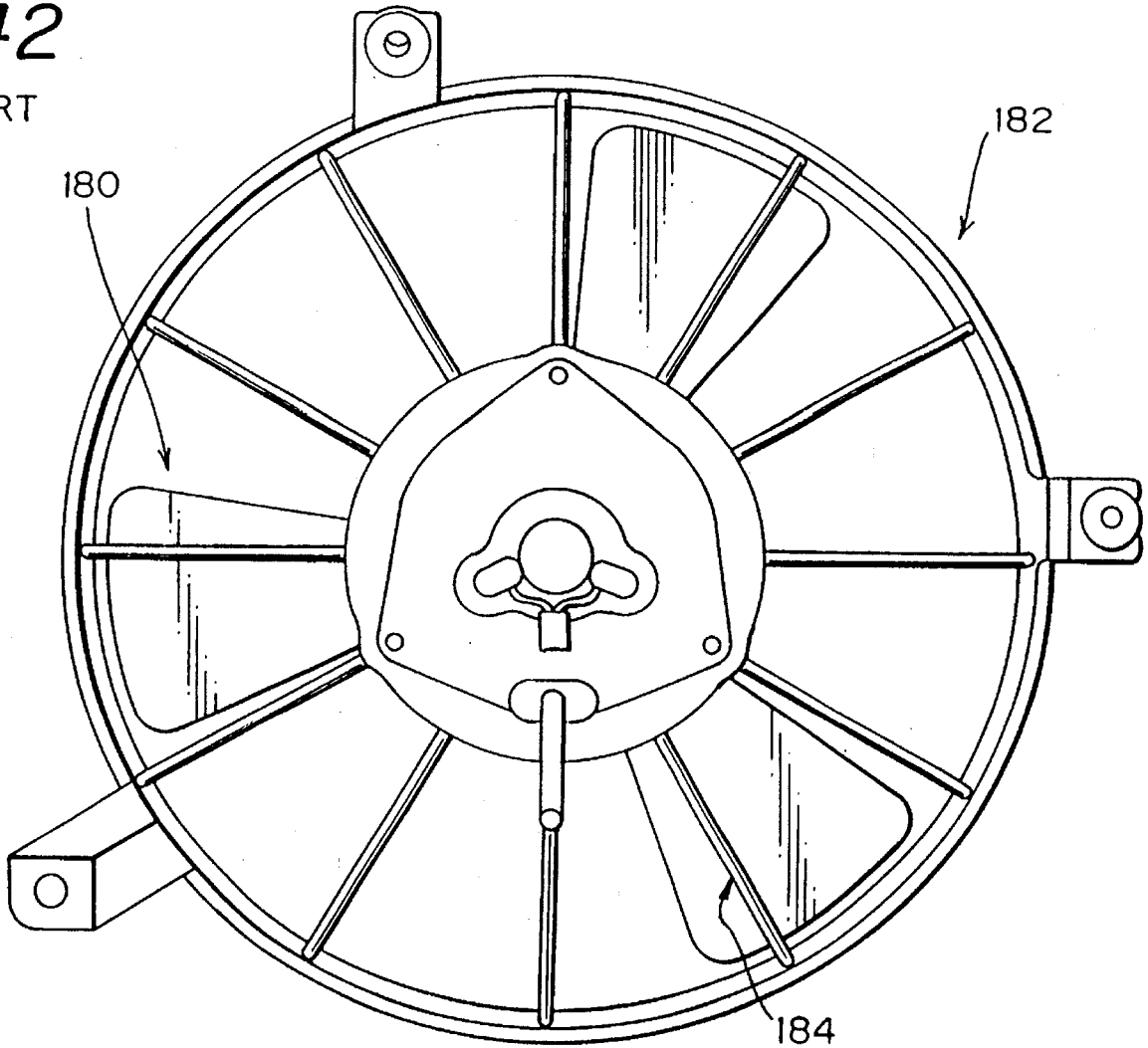
Fig. 42 PRIOR ART
FIG. 42 shows another construction from the prior art.
Figure 43:
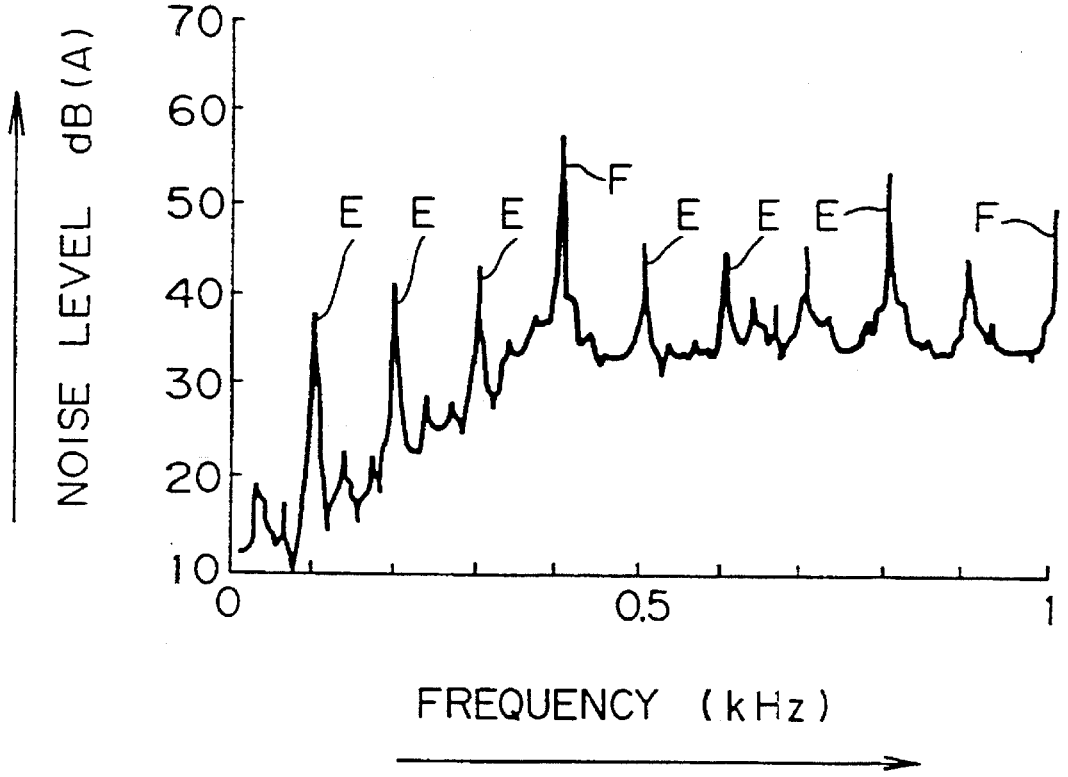
Fig. 43 PRIOR ART
FIG. 43 illustrates the relationship between the frequency and the noise level for the fan in the prior art in FIG. 42.

FIG. 40 shows another example of the prior art, where in order to prevent the pitch of the stay and pitch of the blades from being deformed, a fan 170 in FIG. 42 includes three blades 172, and a stay device 174 which includes five stay members 171. As shown in FIG. 43, the rotational speed of the fan 170 of 2,000 r.p.m. causes a basic peak to be created at a frequency of 500 Hz and peak frequencies to also appear at frequencies corresponding to a multiple of the basic frequency as shown in FIG. 41. In addition, peaks E also appear in noise created due to the fact that the rotating blades 172 rotate or break through the air, which is referred to as air breaking noise.

The existence of the peak D in the interference noise causes the noise to increase. In order to suppress such a noise, it is proposed to make the pitch of the fan blades uneven. However, this causes the flow of the air between the blades 172 to be uneven, which causes the overall noise level to be increased. Furthermore, an interference noise also appears due to the provision of the equiangularly spaced stay members 171. Therefore, a reduction in the noise cannot be realized.

In another approach, it has also been proposed to locate peak of the interference noise in a higher frequency range which is, from the viewpoint of audibility, less uncomfortable. As mentioned above, the frequency of noise larger than 2 KHz is less uncomfortable, due to the fact that the sensory noise level is reduced and that the noise due to the peak itself is less audible. In order to move the peak frequency to a higher value, the rotational speed of the fan should be increased. This however, causes the air breaking noise to be increased. To compensate for this, an increased number of blades and stays is required to obtain an increased peak in the interference noise peak. Namely, as shown in FIG. 42, a fan may be made, where the number of blades 180 are three, and a stay assembly 182 includes twelve stay members 184. FIG. 43 shows a noise characteristic of the fan in FIG. 42 at a rotational speed of the fan of 2,000 r.p.m., wherein a reduction occurs in the basic frequency of the noise F to 400 Hz, which is lower than the basic frequency of 500 Hz shown in FIG. 41 for the fan shown in FIG. 40. A number of stay members 184 as well as the blades can be increased, for example, to twelve. However, such a mere increase in the number of the stay members and the blades still maintains the basic frequency of the noise at 400 Hz. Basically, merely increasing the number of the stay members and blades is ineffective for increasing the basic peak frequency.

Contrary to this, according to the present invention, in FIG. 35, the number x of the stays and the number y of the blades are in such a relationship that they cannot be evenly divided by each other. Thus, the basic peak frequency in the interference noise between the stay members and the blades, which is determined by the least common multiple between x and y, is increased.

In the third aspect of the present invention in FIGS. 35 to 37, motor 20 and the stay assembly 22 are arranged upstream of the fan 120. In place of this construction, the motor and the stay assembly can be arranged downstream from the fan. In this case, the arrangement would be such that a peak of interference noise due to a pressure variation on the respective blades at their immediate downstream portions is shifted to a higher frequency. Furthermore, the electric motor can be a variable speed type. In this case, the requirement in the present invention between the numbers x and y should, at least, be satisfied at a higher rotational speed. Finally, the present invention can be modified so that a protection screen can be combined with the stay assembly.

Although the embodiments of the present invention are explained where the invention is applied to a fan in an engine room of an automobile, the present invention can be applied to different uses in various appliances, such as a ventilation fan and a domestic cooling fan.

We claim:

1. An axial flow fan comprising:

a boss portion defining an axis; and at least seven circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees;

an inclining angle $\Theta$ of said front edge, which is an angle of a tangential line to said front edge at a selected radial location to a radial line from the location to the center of the axis, being in a range between −20 to 10 degrees at said root end, and being in a range between 50 to 70 degrees at said tip end, and wherein said value of the inclination angle increases continuously and gradually from said root end to said tip end.

2. An axial flow fan comprising:

a boss portion; and at least seven circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees;

wherein said blade forms, at a circumferential cross section thereof, a substantial arc shape recessed in a direction opposite to the rotating movement of the fan, and wherein a ratio of a bending height h of said blade to a chord length L rapidly increases from a middle radial position on said blade to said root end, and is, at said root end, in a range between 7% to 15%.

3. An axial flow fan comprising:

a boss portion; and at least seven circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees;

wherein a solidity of the blade, which is a ratio of a chord length of the blade to a blade pitch of the fan, is gradually reduced from said root end to said tip end of said blade, and the value of said solidity at said tip end is between 0.7 to 0.95.

4. An axial flow fan comprising:

a boss portion defining an axis; and between nine and thirteen circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees;

an inclining angle $\Theta$ of said front edge, which is an angle of a tangential line to said front edge at a selected radial location to a radial line from the location to the center of the axis, being in a range between −20 to 10 degrees at said root end, and being in a range between 50 to 70 degrees at said tip end, and wherein said value of the inclination angle increases continuously and gradually from said root end to said tip end.

5. An axial flow fan comprising:

a boss potion; and between nine and thirteen circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees;

wherein said blade forms, at a circumferential cross section thereof, a substantial arc shape recessed in a direction opposite to the rotating movement of the fan, and wherein a ratio of a bending height h of said blade to a chord length L rapidly increases from a middle radial position on said blade to said root end, and is, at said root end, in a range between 7% to 15%.

6. An axial flow fan comprising:

a boss portion; and between nine and thirteen circumferentially spaced, radially extending blades coupled to said boss portion, each of said blades comprising a root end, a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ between 35 and 45 degrees; wherein a solidity of the blade, which is a ratio of a chord length of the blade to a blade pitch of the fan, is gradually reduced from said root end to said tip end of said blade, and the value of said solidity at said tip end is between 0.7 to 0.95.

7. An axial flow fan assembly comprising:

a motor for generating a rotating movement, said motor having a housing;

a fan comprising:

a boss portion driven by said motor, and a plurality of equiangularly spaced, radially extending blades coupled to said boss portion; and a stay unit comprising:

a supporting member, and a plurality of equiangularly spaced stay members extending radially, each of said stay members having an outer end connected to said supporting member and an inner end connected to said housing of said motor, so that said stay members are located on one side of said fan;

wherein the number x of said stay members and the number y of said blades are undividable evenly by each other and satisfy the following relationship, $2{,}000<(x) \times (y) \times (N_f/60)$, where $N_f$ is a rotational speed of the fan.

8. An axial flow fan assembly according to claim 7, further comprising a shroud member of a tubular shape which is integral with at least one of said stay members and is located substantially around said fan.

9. An axial flow fan assembly comprising:

a motor for generating a rotating movement, said motor having a housing;

a fan comprising:

a boss portion defining an axis and driven by said motor, and at least seven circumferentially spaced, radially extending blades which are substantially adjacent to each other when viewed along said axis, said blades being coupled to said boss;

at least an adjacent pair of said blades defining a gap therebetween, said gap having a substantially constant value along an entire radial length of said blades; and a stay unit comprising:

a supporting member; and a plurality of equiangularly spaced stay members extending radially, each of said stay members having an outer end connected to said supporting member and an inner end connected to said housing of said motor, so that said stay members are located on one side of said fan;

wherein the number x of said stay members and the number y of said blades are undividable evenly by each other and satisfy the following relationship, $2{,}000<(x) \times (y) \times N_f/60$, where $N_f$ is a rotational speed of the fan.

10. An axial flow fan assembly according to claim 9, further comprising a shroud member of tubular shape which is integral with at least one of said stay members and is located substantially around said fan.

11. An axial flow fan comprising:

a boss portion having an axis;

at least seven circumferentially spaced, radially extending blades coupled to said boss portion, each of said blades comprising a root end a front edge, a tip end, and a rear edge, each pair of adjacent blades defining a gap therebetween, said gap having a substantially constant value along the entire length of said blades;

said front edge being curved in the direction of rotation of said fan from said root end to said tip end of said blades and wherein said front edge forms a sweep forward angle $\phi$ having value between 35 and 45 degrees;

an inclining angle $\Theta$ of said front edge, which is an angle between a line tangential line to said front edge at a selected radial location to a radial line from said selected radial location to the center of said axis, having a value between −20 and 10 degrees at said root end, and a value between 50 to 70 degrees at said tip end, and wherein said value of said inclination angle increases continuously and gradually from said root end to said tip end;

at least one of said blades forming a substantially arc shaped portion at a circumferential cross section of said blade and said arc shaped portion being recessed in a direction opposite to said rotation;

a ratio of a bending height to a chord length of said blade rapidly increasing from a middle radial position on said blade to said root end of said blade and having a value between 7% and 15%; and a solidity of said blade, which is a ratio of a chord length of the blade to a blade pitch of the fan, gradually reducing from said root end to said tip end of said blade, and the value of said solidity at said tip end being between 0.7 to 0.95.

* * * * *